US009851134B2

(12) United States Patent
Ishimura et al.

(10) Patent No.: US 9,851,134 B2
(45) Date of Patent: Dec. 26, 2017

(54) AIR-CONDITIONING APPARATUS

(75) Inventors: Katsuhiro Ishimura, Tokyo (JP); Koji Yamashita, Tokyo (JP); Hiroyuki Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 342 days.

(21) Appl. No.: 14/394,280

(22) PCT Filed: May 11, 2012

(86) PCT No.: PCT/JP2012/003078

§ 371 (c)(1),
(2), (4) Date: Oct. 14, 2014

(87) PCT Pub. No.: WO2013/168199

PCT Pub. Date: Nov. 14, 2013

(65) Prior Publication Data

US 2015/0075194 A1 Mar. 19, 2015

(51) Int. Cl.
*F25B 49/00* (2006.01)
*F25B 49/02* (2006.01)
(Continued)

(52) U.S. Cl.
CPC ..... *F25B 49/022* (2013.01); *F25B 9/006* (2013.01); *F25B 13/00* (2013.01); *F25B 45/00* (2013.01);
(Continued)

(58) Field of Classification Search
CPC ..... F25B 49/022; F25B 13/00; F25B 9/006; F25B 45/00; F25B 49/005;
(Continued)

(56) References Cited

U.S. PATENT DOCUMENTS 5,410,887 A * 5/1995 Urata ..... C09K 5/045 62/114
5,626,026 A * 5/1997 Sumida ..... F25B 9/006 62/129
5,996,358 A * 12/1999 Sumida ..... C09K 5/045 62/114

FOREIGN PATENT DOCUMENTS

EP 0898133 A2 2/1999
JP 08-121881 A 5/1996
(Continued)

OTHER PUBLICATIONS

Communication pursuant to Article 94(3) EPC dated Mar. 13, 2017 issued in the corresponding EP application No. 12876165.7.
(Continued)

*Primary Examiner* — Elizabeth Martin
(74) *Attorney, Agent, or Firm* — Posz Law Group, PLC

(57) ABSTRACT

An air-conditioning apparatus includes a refrigerant circuit formed by connecting a compressor that discharges a zeotropic refrigerant, an outdoor-side heat exchanger that exchanges heat between outside air and the refrigerant, a first expansion device that regulates the pressure of the refrigerant, and a load-side heat exchanger that exchanges heat between the air in an air-conditioning target space and the refrigerant. The air-conditioning apparatus includes a controller that has a composition computing function unit and a composition determining function unit The composition determining function unit is configured to adopt a predetermined value set in advance and related to composition as a circulating composition if the computation result is determined as incorrect, and adopt the computation result as the circulating composition if the computation result is determined as correct.

15 Claims, 12 Drawing Sheets

(51) Int. Cl.

| | |
|---|---|
| ***F25B 9/00*** | (2006.01) |
| ***F25B 13/00*** | (2006.01) |
| ***F25B 45/00*** | (2006.01) |

(52) U.S. Cl.
CPC ... *F25B 49/005* (2013.01); *F25B 2313/02741* (2013.01); *F25B 2500/19* (2013.01); *F25B 2600/02* (2013.01); *F25B 2600/11* (2013.01)

(58) Field of Classification Search
CPC ..... F25B 2313/02741; F25B 2500/19; F25B 2600/02; F25B 2600/11
See application file for complete search history.

(56) References Cited

FOREIGN PATENT DOCUMENTS

| | | | |
|---|---|---|---|
| JP | 09-068356 | A | 3/1997 |
| JP | 11-063747 | A | 3/1999 |
| JP | 11-182951 | A | 7/1999 |
| JP | 2001-141322 | A | 5/2001 |
| JP | 2003-314914 | A | 11/2003 |

OTHER PUBLICATIONS

Extended European Search Report dated Mar. 2, 2016 in the corresponding EP application No. 12876165.7.
International Search Report of the International Searching Authority dated Jul. 10, 2012 for the corresponding international application No. PCT/JP2012/003078 (and English translation).

* cited by examiner

AIR-CONDITIONING APPARATUS

CROSS REFERENCE TO RELATED APPLICATION

This application is a U.S. national stage application of International Application No. PCT/JP2012/003078 filed on May 11, 2012, the disclosure of which is incorporated herein by reference.

TECHNICAL FIELD

The present invention relates to an air-conditioning apparatus that performs air conditioning by using, for example, a zeotropic refrigerant mixture.

BACKGROUND ART

For reasons such as enhanced operational efficiency and environmental considerations, there are air-conditioning apparatuses that perform air conditioning by using a zeotropic refrigerant mixture in which a plurality of refrigerants with different boiling points are mixed. For example, in some conventional air-conditioning apparatuses using a zeotropic refrigerant mixture such as multi-air-conditioning apparatuses for buildings, a composition-sensing bypass circuit is added to the main refrigerant circuit to sense the composition (circulating composition) of a zeotropic refrigerant mixture circulating through the refrigerant circuit. For example, the composition-sensing bypass circuit is formed by composition-sensing heat exchangers and an expansion device, with temperature and pressure sensors attached in the flow path. A part of the refrigerant discharged from the compressor is caused to flow through the composition-sensing heat exchanger (high-pressure side), the expansion device, and the composition-sensing heat exchanger (low-pressure side) in the order named, and bypassed to the suction portion (suction-side pipe) of the accumulator. At this time, the temperature of the refrigerant in a supercooled liquid state (supercooled liquid refrigerant) at the outlet of the composition-sensing heat exchanger (high-pressure side), the temperature of the refrigerant that is in a two-phase state (two-phase refrigerant) after passing through the expansion device, and the pressure (low-pressure side pressure) at the suction portion of the accumulator are detected by the temperature and pressure sensors. Then, the circulating composition is computed on the basis of the temperature of the supercooled liquid refrigerant, the two-phase refrigerant temperature, and the low-pressure side pressure (see, for example, Patent Literature 1).

CITATION LIST

Patent Literature

Patent Literature 1: Japanese Unexamined Patent Application Publication No. 2003-314914 (FIG. 1 and the like)

SUMMARY OF INVENTION

Technical Problem

As described above, conventional air-conditioning apparatuses using a zeotropic refrigerant mixture perform control by deriving the circulating composition by computation on the basis of the temperature of the supercooled liquid refrigerant, the two-phase refrigerant temperature, and the low-pressure side pressure. In this regard, various operational states exist as represented by operation modes such as cooling operation and heating operation, operating conditions such as outdoor temperature and indoor temperature, the number of indoor units to be operated, and so on. For this reason, depending on the operational state, the refrigerant at the high-pressure-side outlet of the composition detection heat exchanger does not always become a supercooled liquid state, or the refrigerant that has passed through the expansion device does not always become a two-phase state. Computing the circulating composition in such an operational state may sometimes result in the computed result being significantly different from the real circulating composition. Controlling an air-conditioning apparatus on the basis of such a different circulating composition may lead to the possibility of deterioration in efficiency.

The present invention has been made in view of the above-mentioned problem, and accordingly the present invention provides an air-conditioning apparatus that can operate efficiently on the basis of an appropriate circulating composition.

Solution to Problem

An air-conditioning apparatus according to the present invention is An air-conditioning apparatus in which a refrigerant circuit is formed by connecting, by a refrigerant pipe, a compressor that discharges a refrigerant, which is a zeotropic refrigerant mixture including a plurality of components with different boiling points, an outdoor-side heat exchanger that exchanges heat between air outside an air-conditioning target space and the refrigerant, a first expansion device that regulates a pressure of the refrigerant, and a load-side heat exchanger that exchanges heat between air in the air-conditioning target space and the refrigerant, the air-conditioning apparatus comprising a controller, the controller including: a composition computing function unit configured to compute a circulating composition, the circulating composition representing a value of composition of each of components in the refrigerant circulating through the refrigerant circuit; and a composition determining function unit configured to determine whether or not a computation result of the composition computing function unit is correct, adopt a predetermined value set in advance and related to composition as the circulating composition if the computation result is determined as incorrect, and adopt the computation result as the circulating composition if the computation result is determined as correct.

Advantageous Effects of Invention

With the air-conditioning apparatus according to the present invention, in the controller, the composition determining function unit determines whether or not the computation result of the composition computing function unit is appropriate, and if the computation result is determined as not appropriate, the composition determining function unit adopts a previously set predetermined value as the circulating composition. Therefore, a control based on an appropriate circulating composition can be performed, thereby making it possible to obtain an air-conditioning apparatus with good operational efficiency. As a result, energy saving can be achieved.

DESCRIPTION OF EMBODIMENTS

Embodiment 1

Figure 1:
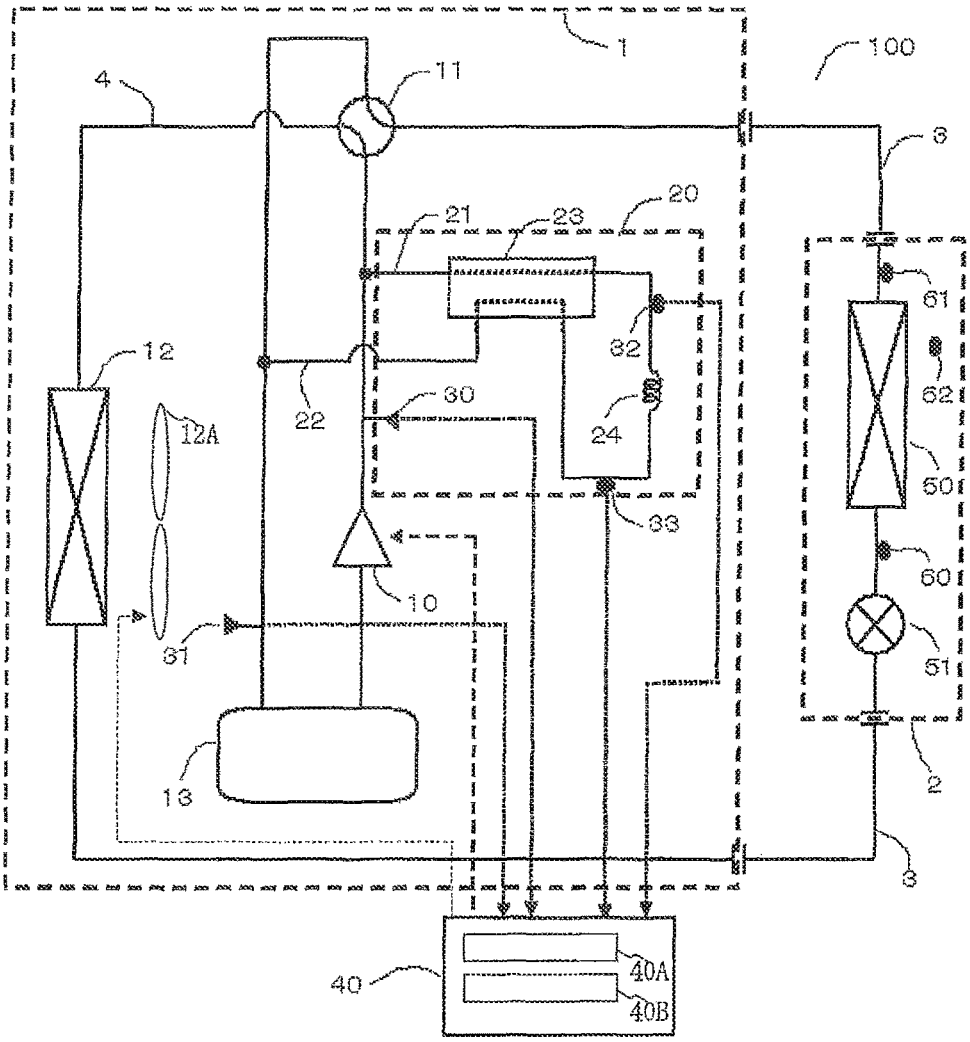
FIG. 1 is a schematic diagram illustrating an example of the apparatus configuration of an air-conditioning apparatus according to Embodiment 1 of the present invention.

FIG. 1 is a schematic diagram illustrating an example of the apparatus configuration of an air-conditioning apparatus according to Embodiment 1 (hereinafter, referred to as air-conditioning apparatus 100). A configuration of the air-conditioning apparatus 100 will be described with reference to FIG. 1. In the following description, when a temperature, a pressure, or the like is described as being high, low, or the like, this is not determined in relation to a specific absolute value but is determined relatively depending on the state, operation, or the like of the apparatus or the like.

The air-conditioning apparatus 100 according to Embodiment 1 is an apparatus that performs air conditioning using a refrigeration cycle by circulating a zeotropic refrigerant mixture made up of a plurality of refrigerants with different boiling points (for example, a refrigerant in which an R32 refrigerant and an R1234yf refrigerant are mixed at mass ratios of 44 wt % (percent by weight) and 56 wt % (percent by weight)). In the air-conditioning apparatus 100 according to Embodiment 1, an outdoor unit 1 and an indoor unit 2 are connected by a refrigerant main pipe 3 to form a refrigerant circuit. As for the operation mode, it is possible to select a cooling operation mode in which the indoor unit 2 to be operated performs cooling, and a heating operation mode in which the indoor unit 2 to be operated performs heating.

<Outdoor Unit 1>

The outdoor unit 1 includes a compressor 10, a refrigerant flow switching device 11 such as a four-way valve, an outdoor-side heat exchanger 12, and an accumulator 13, which are connected by a refrigerant pipe 4.

The compressor 10 sucks a low-temperature, low-pressure refrigerant, compresses the refrigerant into a high-temperature, high-pressure state, and discharges the resulting refrigerant. The compressor 10 is preferably configured by, for example, an inverter compressor whose capacity can be controlled, although the compressor 10 is not particularly limited to this. The refrigerant flow switching device 11 is a device that switches between the flow of refrigerant in cooling operation mode and the flow of refrigerant in heating operation mode.

The outdoor-side heat exchanger 12 functions as a condenser in cooling operation, and as an evaporator in heating operation. The outdoor-side heat exchanger 12 exchanges heat between air supplied from an outdoor fan (air-sending device) 12A and the refrigerant. The outdoor fan 12A supplies air to the outdoor-side heat exchanger 12 in order to promote heat exchange between the refrigerant and air in the outdoor-side heat exchanger 12. The rotation speed of the outdoor fan 12A can be varied on the basis of control by a controller 40. The accumulator 13 is provided on the suction side of the compressor 10. The accumulator 13 accumulates surplus refrigerant produced owing to the difference in operational state between cooling operation and heating operation or surplus refrigerant for transient changes in operation.

The air-conditioning apparatus 100 has a composition detection circuit 20 provided in the main refrigerant circuit. The composition detection circuit 20 has a first pipe 21, a second pipe 22, a composition detection heat exchanger 23, and a second expansion device 24. The first pipe 21 is a pipe that is branched from the refrigerant pipe 4 that connects the discharge portion of the compressor 10 and the refrigerant flow switching device 11, and used to bypass a part of the refrigerant discharged from the compressor 10. The second pipe 22 is a pipe that is branched from the refrigerant pipe 4 that connects the refrigerant flow switching device 11 and the accumulator 13, and used to merge a refrigerant flow with the refrigerant flowing on the suction side of the compressor 10. The composition detection heat exchanger 23 exchanges heat between the flow of refrigerant through the first pipe 21 and the flow of refrigerant through the second pipe 22. The second expansion device 24 is provided between the composition detection heat exchanger 23 and the second pipe 22. Although the second expansion device 24 is depicted as a capillary tube in FIG. 1, the second expansion device 24 may be configured by any device as long as the second expansion device 24 reduces the pressure of refrigerant so that the refrigerant expands, such as a fixed-throttle pressure reducing valve that operates by another principle, or an electronic expansion valve that is driven by a stepping motor and whose opening degree varies.

The outdoor unit 1 has a first pressure detecting device 30 and a second pressure detecting device 31 as pressure detecting devices (pressure sensors). The first pressure detecting device 30 serving as a high-pressure side pressure detecting device is provided in the refrigerant pipe 4 that connects the compressor 10 and the refrigerant flow switching device 11. The first pressure detecting device 30 detects the pressure (high-pressure side pressure) of a high-temperature, high-pressure refrigerant compressed and discharged by the compressor 10, as a detection value $P_1$. The second pressure detecting device 31 serving as a low-pressure side pressure detecting device is provided in the refrigerant pipe 4 that connects the refrigerant flow switching device 11 and the accumulator 13. The second pressure detecting device 31 detects the pressure (low-pressure side pressure) of a low-temperature, low-pressure refrigerant sucked by the compressor 10 as a detection value $P_2$.

The composition detection circuit 20 has a first temperature detecting device 32 and a second temperature detecting device 33 as temperature detecting devices (temperature sensors). The first temperature detecting device 32 serving as a supercooled liquid temperature detecting device is provided in the first pipe 21 connected to the upstream side of the second expansion device 24. The first temperature detecting device 32 detects, a detection value $T_1$, the temperature (supercooled liquid refrigerant temperature) of a supercooled liquid refrigerant at high pressure that has flowed out of the composition detection heat exchanger 23. The second temperature detecting device 33 serving as a two-phase refrigerant temperature detecting device is provided in the second pipe 22 connected to the downstream side of the second expansion device 24. The second temperature detecting device 33 detects, as a detection value $T_2$, the temperature (two-phase refrigerant temperature) of a low-pressure refrigerant in a two-phase gas-liquid state whose pressure has been reduced by the second expansion device 24. In this regard, the first temperature detecting device 32 and the second temperature detecting device 33 may each be configured by, for example, a thermistor.

The air-conditioning apparatus 100 according to Embodiment 1 has a controller 40 provided in the outdoor unit 1. The controller 40 executes processing on the basis of, for example, an instruction inputted from a remote controller, or detection values detected by various detecting devices, and controls devices that constitute the air-conditioning apparatus 100. Examples of the control of devices includes control of the frequency of the compressor 10, the rotation speed (including ON/OFF) of the outdoor fan 12A, switching of the refrigerant flow switching device 11, and the opening degree of a first expansion device 51.

The controller 40 according to Embodiment 1 has, in particular, a composition computing function unit 40A and a composition determining function unit 40B. The composition computing function unit 40A is configured to compute the composition of refrigerant components in a refrigerant mixture that circulates within the refrigerant circuit at least from the detection value $T_1$ detected by the first temperature detecting device 32, the detection value $T_2$ detected by the second temperature detecting device 33, and the detection value $P_2$ detected by the second pressure detecting device 31. The composition determining function unit 40B determines whether or not it is possible to sense the composition of the refrigerant flowing on the upstream side of the second expansion device 24, on the basis of the detection value $T_1$ detected by the first temperature detecting device 32 and the detection value $P_1$ detected by the first pressure detecting device 31. Further, the composition determining function unit 40B determines whether or not it is possible to sense the composition of refrigerant flowing on the downstream side of the second expansion device 24, on the basis of the detection value $T_2$ detected by the second temperature detecting device 33, and the detection value $P_2$ detected by the second pressure detecting device 31. Then, the rotation speed of the compressor 10 or/and the outdoor fan 12A is controlled on the basis of the composition computed by the composition computing function unit 40A, the result of the determination by the composition determining function unit 40B as to whether or not sensing of the composition is possible, and the detection value $P_1$ and the detection value $P_2$. While the controller 40 is provided in the outdoor unit 1 in this example, the controller 40 may be provided in the indoor unit 2. Further, the controller 40 may be provided in each of the outdoor unit 1 and the indoor unit 2.

With regard to the controller 40, the controller 40 may be configured solely by a dedicated device (hardware). Further, for example, the hardware may be configured by computation control means (computer) configured mainly of a central processing unit (CPU). Procedures executed by the composition computing function unit 40A, the composition determining function unit 40B, and the like may be defined as programs in advance and stored as software, firmware, or the like in, for example, storage means or the like provided in the controller 40, and the computation control means may execute the programs to thereby execute processing of various units.

<Indoor Unit 2>

The indoor unit 2 is equipped with a load-side heat exchanger 50, and the first expansion device 51. The indoor unit 2 connects to the outdoor unit 1 via the refrigerant main pipe 3, and refrigerant enters and flows out of the indoor unit 2. The load-side heat exchanger 50 exchanges heat between, for example, the air supplied from an indoor fan (not illustrated) and the refrigerant, and generates heating air or cooling air that is to be supplied to an air-conditioning target space. The first expansion device 51 functions as a pressure reducing valve or an expansion valve, and reduces the pressure of refrigerant to cause the refrigerant to expand. The first expansion device 51 is preferably configured by, for example, an electronic expansion valve whose opening degree can be variably controlled.

The indoor unit 2 is also provided with a third temperature detecting device 60 for detecting the temperature of refrigerant entering the load-side heat exchanger 50 in cooling operation, a fourth temperature detecting device 61 for detecting the temperature of flow of refrigerant out of the load-side heat exchanger 50, and a fifth temperature detecting device 62 for detecting indoor air temperature. The third temperature detecting device 60 is provided in the pipe that connects the first expansion device 51 and the load-side heat exchanger 50. The fourth temperature detecting device 61 is provided in the pipe located on the side opposite to the first expansion device 51 with respect to the load-side heat exchanger 50. The fifth temperature detecting device 62 is provided in the air suction portion of the load-side heat exchanger 50. Each of these temperature detecting devices is preferably configured by, for example, a thermistor.

<Cooling Operation Mode>

Figure 2:
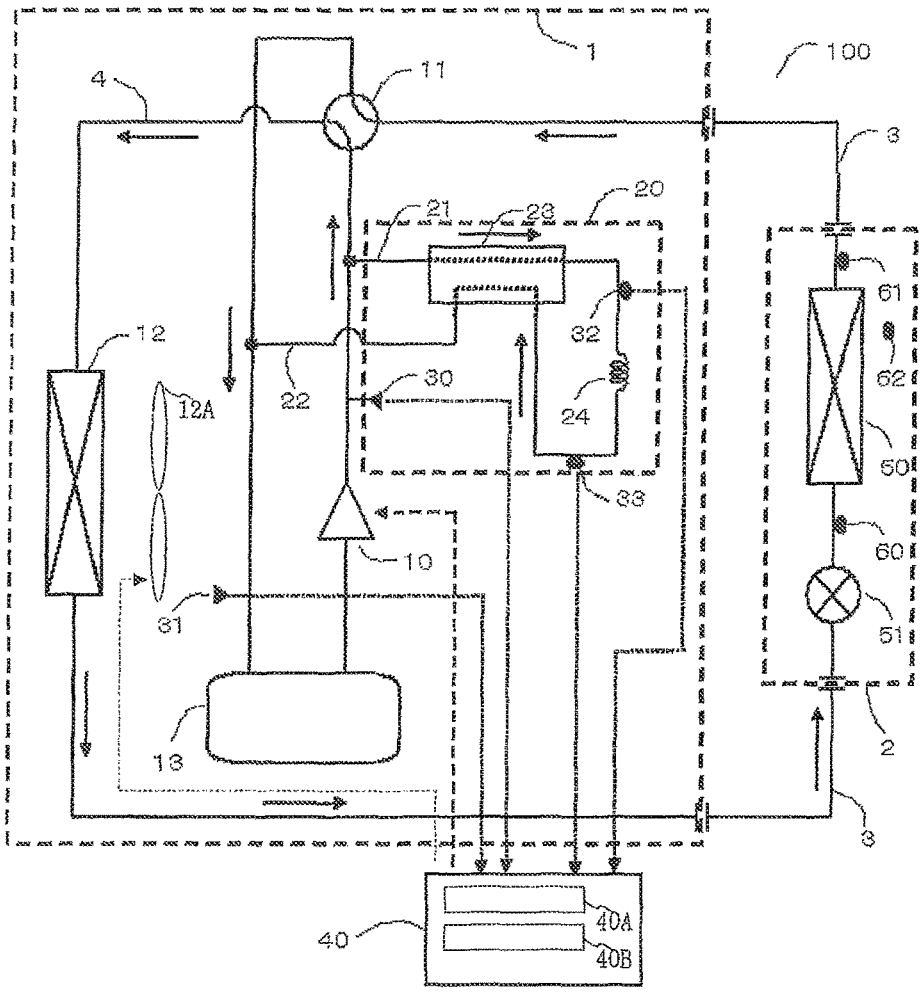
FIG. 2 illustrates a flow of refrigerant in cooling operation mode of an air-conditioning apparatus 100.

FIG. 2 illustrates a flow of refrigerant in cooling operation mode of the air-conditioning apparatus 100. In FIG. 2, the flow direction of refrigerant is indicated by solid arrows. In FIG. 2, the cooling operation mode will be described with respect to a case where a cooling load is generated in the load-side heat exchanger 50.

In the case of the cooling operation mode illustrated in FIG. 2, a low-temperature, low-pressure refrigerant is compressed by the compressor 10, and discharged as a high-temperature, high-pressure gas refrigerant. The high-temperature, high-pressure gas refrigerant discharged from the compressor 10 is branched into a flow of refrigerant through the main refrigerant circuit which enters the refrigerant flow switching device 11, and a flow of refrigerant that is bypassed to the first pipe 21. The flow of refrigerant through the main refrigerant circuit enters the outdoor-side heat exchanger 12 via the refrigerant flow switching device 11. The high-temperature/high-pressure gas refrigerant that has entered the outdoor-side heat exchanger 12 condenses and turns into a high-pressure liquid refrigerant while rejecting heat to the outdoor air. Then, the high-pressure liquid refrigerant that has flowed out of the outdoor-side heat exchanger 12 flows out of the outdoor unit 1, passes through the refrigerant main pipe 3, and enters the indoor unit 2. The high-pressure liquid refrigerant that has entered the indoor unit 2 is reduced in pressure into a low-temperature, low-pressure two-phase refrigerant by the first expansion device 51, enters the load-side heat exchanger 50 serving as an evaporator, cools the indoor air while removing heat from the indoor air, and turns into a low-temperature, low-pressure gas refrigerant. The low-temperature, low-pressure gas refrigerant that has flowed out of the load-side heat exchanger 50 passes through the refrigerant main pipe 3 and enters the outdoor unit 1. The refrigerant that has entered the outdoor unit 1 passes through the refrigerant flow switching device 11 and the accumulator 13, and is sucked into the compressor 10.

At this time, the controller 40 controls the opening degree of the first expansion device 51 so that the superheat (degree of superheat) obtained as the difference between the saturation temperature of refrigerant, which is calculated from the pressure detected by the second pressure detecting device 31 and the composition of refrigerant passing through the composition detection circuit 20, and the temperature detected by the fourth temperature detecting device 61 becomes constant.

Meanwhile, a part of the high-temperature, high-pressure gas refrigerant discharged from the compressor 10 which is branched to the first pipe 21 enters the composition detection heat exchanger 23. The high-temperature, high-pressure gas refrigerant that has entered the composition detection heat exchanger 23 turns into a high-pressure supercooled liquid refrigerant by rejecting heat to the low-temperature, low-pressure two-phase refrigerant whose pressure has been reduced by the second expansion device 24, and then the high-pressure supercooled liquid refrigerant enters the second expansion device 24. Then, after the high-pressure supercooled liquid refrigerant is reduced in pressure by the second expansion device 24 into a low-temperature, low-pressure two-phase refrigerant, the low-temperature, low-pressure two-phase refrigerant enters the composition detection heat exchanger 23 again, and turns into a low-pressure gas refrigerant by removing heat from the high-temperature, high-pressure gas flow of refrigerant through the first pipe 21. The low-pressure gas refrigerant that has passed through the composition detection heat exchanger 23 passes through the second pipe 22 and merges with the refrigerant pipe 4 located on the upstream side of the accumulator 13.

<Heating Operation Mode>

Figure 3:
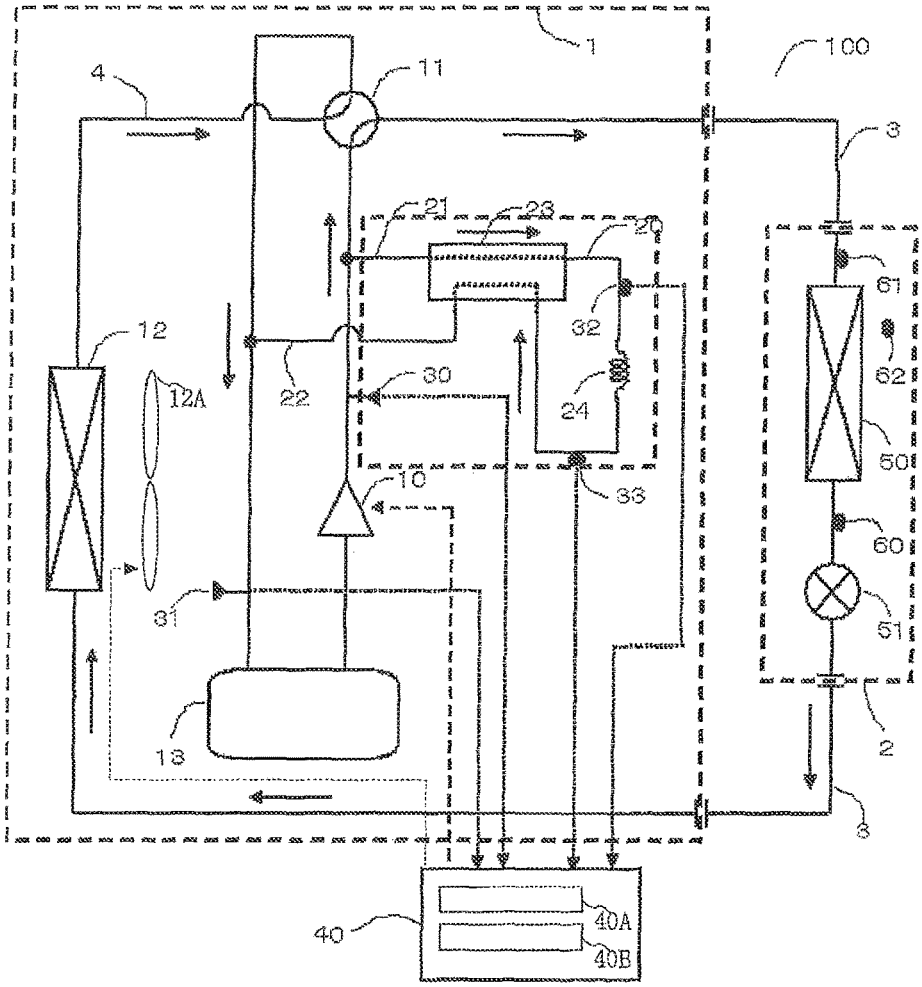
FIG. 3 illustrates a flow of refrigerant in heating operation mode of the air-conditioning apparatus 100.

FIG. 3 illustrates a flow of refrigerant in heating operation mode of the air-conditioning apparatus 100. In FIG. 3, the flow direction of refrigerant is indicated by solid arrows. In FIG. 3, the heating operation mode will be described with respect to a case where a heating load is generated in the load-side heat exchanger 50.

In the case of the heating operation mode illustrated in FIG. 3, a low-temperature, low-pressure refrigerant is compressed by the compressor 10, and discharged as a high-temperature, high-pressure gas refrigerant. The high-temperature, high-pressure gas refrigerant discharged from the compressor 10 is branched into a flow of refrigerant through the main refrigerant circuit which enters the refrigerant flow switching device 11, and a flow of refrigerant that is bypassed to the first pipe 21. The flow of refrigerant through the main refrigerant circuit passes through the refrigerant main pipe 3 via the refrigerant flow switching device 11, and enters the indoor unit 2. The high-temperature, high-pressure gas refrigerant that has entered the indoor unit 2 rejects heat to the indoor air in the load-side heat exchanger 50, turns into a high-pressure liquid refrigerant, and enters the first expansion device 51. Then, after the high-pressure liquid refrigerant is reduced in pressure into a low-temperature, low-pressure two-phase refrigerant by the first expansion device 51, the low-temperature, low-pressure two-phase refrigerant flows out of the indoor unit 2, passes through the refrigerant main pipe 3, and enters the outdoor unit 1. The low-temperature, low-pressure two-phase refrigerant that has entered the outdoor unit 1 turns into a low-temperature, low-pressure gas refrigerant by removing heat from the outdoor air in the outdoor-side heat exchanger 12. The low-temperature, low-pressure gas refrigerant that has flowed out of the outdoor-side heat exchanger 12 passes through the refrigerant flow switching device 11 and the accumulator 13, and is sucked into the compressor 10.

At this time, the controller 40 controls the opening degree of the first expansion device 51 so that the subcooling (supercooling) obtained as the difference between the saturation temperature of refrigerant, which is calculated from the pressure detected by the first pressure detecting device 30 and the composition of refrigerant passing through the composition detection circuit 20, and the temperature detected by the third temperature detecting device 60 becomes constant.

Meanwhile, a part of the high-temperature, high-pressure gas refrigerant discharged from the compressor 10 which is branched to the first pipe 21 flows in the same manner as in cooling operation mode. The refrigerant branched to the first pipe 21 flows through the composition detection heat exchanger 23, the second expansion device 24, the composition detection heat exchanger 23, and the second pipe 22 in the order named, and merges with the main flow of refrigerant in the portion upstream of the accumulator 13.

Figure 4:
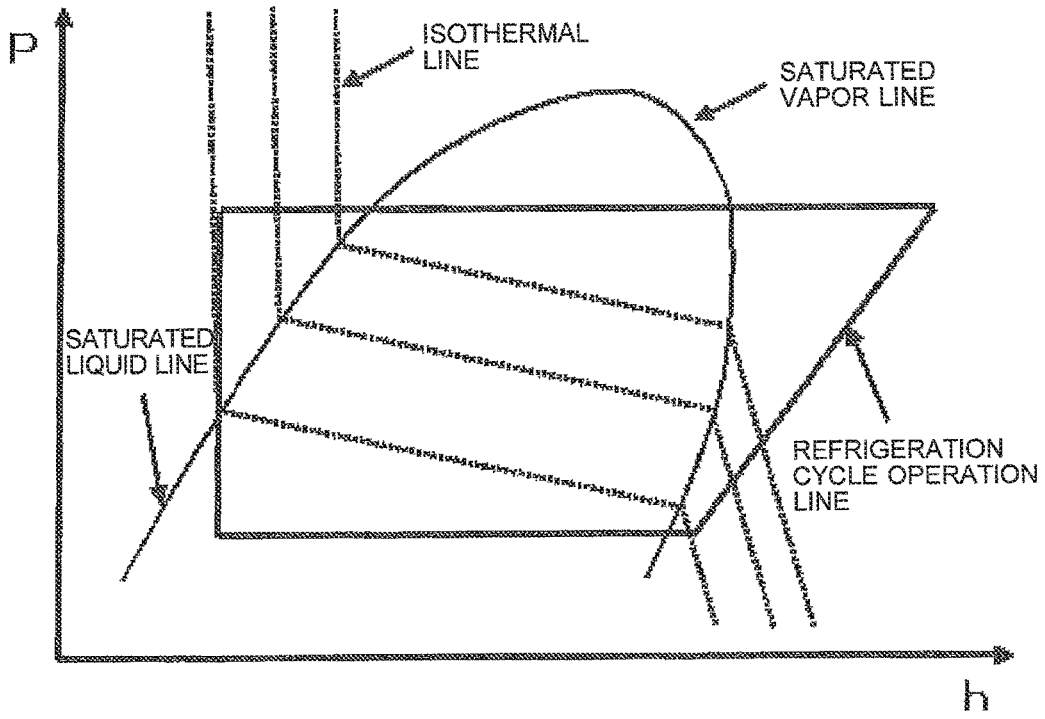
FIG. 4 is a p-h diagram of a zeotropic refrigerant mixture.

FIG. 4 is a p-h diagram of the zeotropic refrigerant mixture. Because the zeotropic refrigerant mixture is made up of a plurality of refrigerant components with different boiling points, the temperature of saturated liquid refrigerant and the temperature of saturated gas refrigerant at the same pressure differ from each other. Therefore, once the pressure, the temperature, and the composition of the refrigerant mixture are given, the state of the refrigerant is determined at a single point even when the refrigerant is in a two-phase state.

Figure 5:
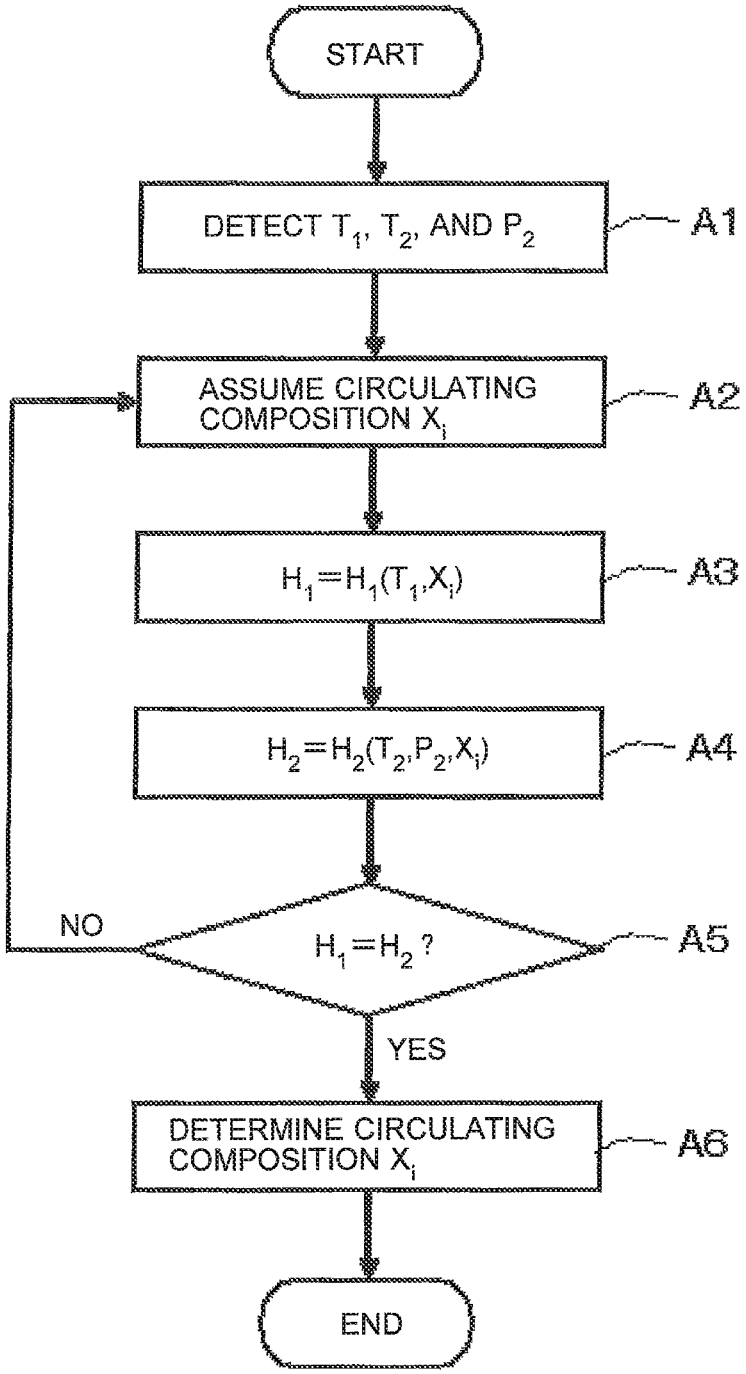
FIG. 5 is a flowchart illustrating a procedure of processing executed by a composition computing function unit 40A for computing the composition of a refrigerant mixture.

FIG. 5 is a flowchart illustrating a procedure of processing executed by the composition computing function unit 40A for computing the composition of the refrigerant mixture. Next, processing in the composition computing function unit 40A of the controller 40 will be described. First, in step A1, detection values $T_1$, $T_2$, and $P_2$ are inputted from the first temperature detecting device 32, the second temperature detecting device 33, and the second pressure detecting device 31, respectively. Next, in step A2, for each component of the refrigerant mixture, its circulating composition $X_i$ is assumed. At this time, the suffix "i" indicates that the composition in question relates to the component of the type "i" of the refrigerant mixture. Next, in step A3, the supercooled liquid enthalpy $H_1$ on the high-pressure side is computed from the circulating composition $X_i$ assumed in step A2, and the detection value $T_1$ detected by the first temperature detecting device 32. Next, in step A4, the enthalpy $H_2$ of refrigerant on the low-pressure side is computed from the circulating composition $X_i$, the detection value $T_2$ detected by the second temperature detecting device 33, and the detection value $P_2$ detected by the second pressure detecting device 31. Next, in step A5, the supercooled liquid enthalpy $H_1$ on the high-pressure side and the enthalpy $H_2$ of refrigerant on the low-pressure side are compared with each other. If the two enthalpies are not equal, the processing returns to step A2, and the assumption of the circulating composition is repeated until the two enthalpies become equal. Finally, in step A6, the value at which $H_1$ and $H_2$ become equal is determined as the circulating composition $X_i$ obtained by computation.

Now, with regard to the composition computing function unit 40A of the controller 40, the high-pressure supercooled liquid enthalpy $H_1$ in step A3 is calculated by Equation (1) below. Further, the enthalpy $H_2$ of the low-pressure refrigerant in step A4 is calculated by Equation (2) below.

$$H_1=H_1(T_1,X_i) \quad (1)$$

$$H_2=H_2(T_2,P_2,X_i) \quad (2)$$

Figure 6:
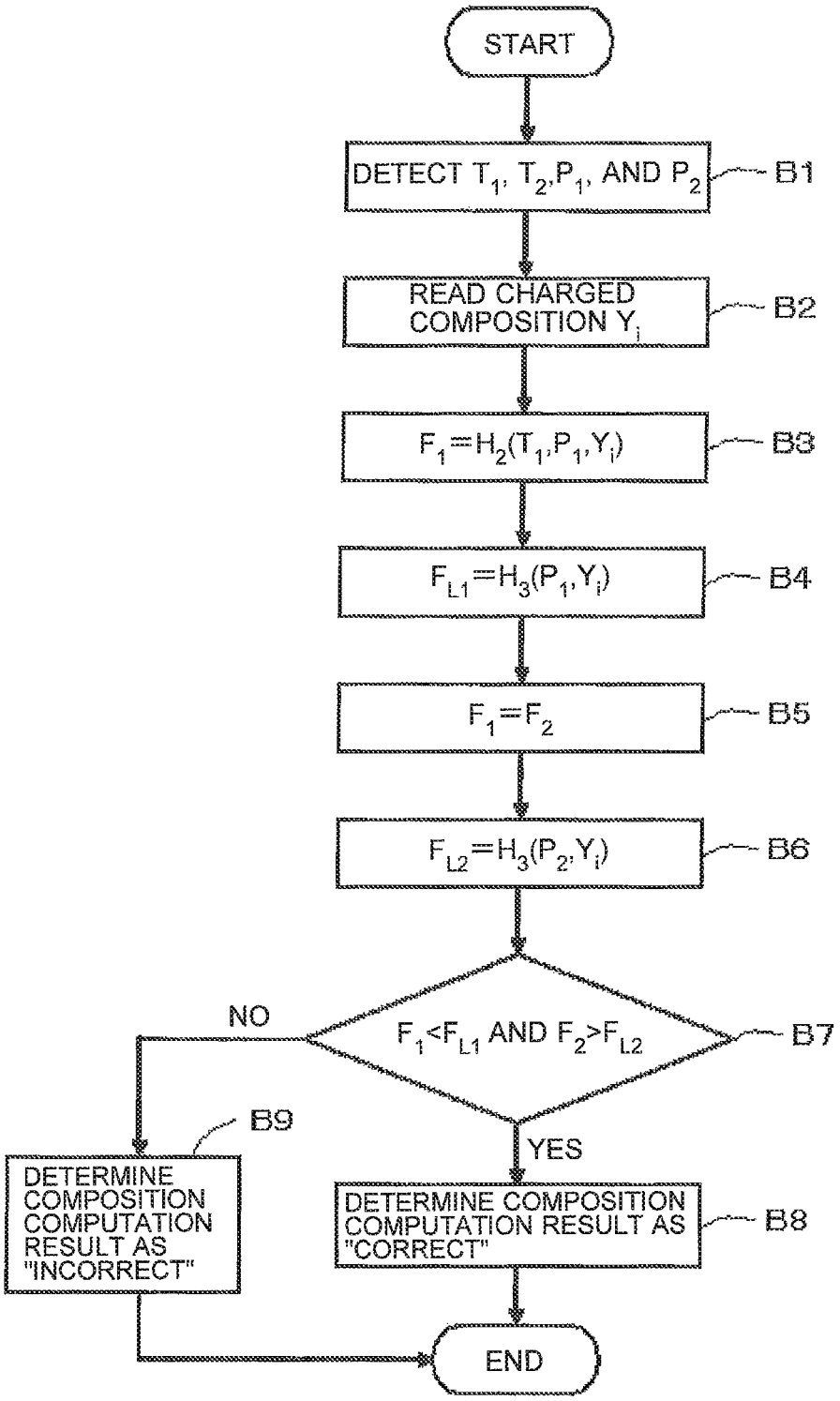
FIG. 6 is a flowchart illustrating a procedure of processing in a composition determining function unit 40B according to Embodiment 1 of the present invention.

FIG. 6 is a flowchart illustrating a procedure of processing in the composition determining function unit 40B according to Embodiment 1. Next, processing in the composition determining function unit 40B of the controller 40 will be described. First, in step B1, the respective detection values $T_1$, $T_2$, $P_1$, and $P_2$ detected by the first temperature detecting device 32, the second temperature detecting device 33, the first pressure detecting device 30, and the second pressure detecting device 31 are read. Next, in step B2, the charged composition of the refrigerant mixture (the composition when the refrigerant is charged into the refrigerant circuit) $Y_i$, which is set to a predetermined value, is read from storage means. At this time, the suffix "i" indicates that the composition in question relates to the component of the type "i" of the refrigerant mixture.

Next, in step B3, a high-pressure supercooled liquid enthalpy $F_1$ in the portion upstream of the second expansion device 24 is computed from the charged composition $Y_i$ read in step B2, and the detection values $T_1$ and $P_1$ respectively detected by the first temperature detecting device 32 and the first pressure detecting device 30. Further, in step B4, a high-pressure saturated liquid enthalpy $F_{L1}$ in the portion upstream of the second expansion device 24 is computed from the charged composition $Y_i$ read in step B2, and the detection value $P_1$ detected by the first pressure detecting device 30.

In step B5, the enthalpy $F_2$ of a low-pressure refrigerant in the portion downstream of the second expansion device 24 is treated as being equal to the high-pressure supercooled liquid enthalpy $F_1$. Further, in step B6, a low-pressure saturated liquid enthalpy $F_{L2}$ in the portion downstream of the second expansion device 24 is computed from the charged composition $Y_i$ read in step B2, and the detection value $P_2$ detected by the second pressure detecting device 31.

Then, in step B7, it is determined whether or not the high-pressure supercooled liquid enthalpy $F_1$ is less than the high-pressure saturated liquid enthalpy $F_{L1}$, and the enthalpy $F_2$ of the low-pressure refrigerant is greater than the low-pressure saturated liquid enthalpy $F_{L2}$. If it is determined that the above-mentioned determination condition is satisfied, the composition computation result is determined as "correct" (step B8). If it is determined that the determination condition is not satisfied, the composition computation result is determined as "incorrect" (step B9).

Now, with regard to the composition determining function unit 40B of the controller 40, the high-pressure supercooled liquid enthalpy $F_1$ in step B3 is calculated by Equation (3) below. The enthalpy $F_{L1}$ of the low-pressure refrigerant in step B4 is calculated by Equation (4) below. The low-pressure saturated liquid enthalpy $F_{L2}$ in step B6 is calculated by Equation (5) below.

$$F_1=H_2(T_1,P_1,Y_i) \quad (3)$$

$$F_{L1}=H_2(P_1,Y_i) \quad (4)$$

$$F_{L2}=H_2(P_2,Y_i) \quad (5)$$

Figure 7:
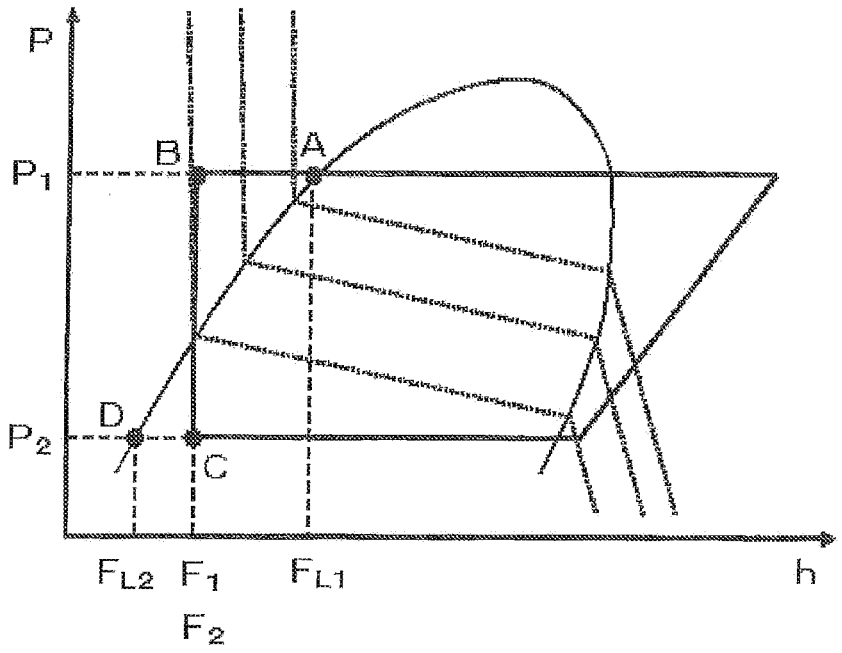
FIG. 7 is a p-h diagram for explaining processing in the composition determining function unit 40B according to Embodiment 1.

FIG. 7 is a p-h diagram for explaining processing in the composition determining function unit 40B according to Embodiment 1. The processing in the composition determining function unit 40B of the controller 40 according to Embodiment 1 described above will be described on the basis of a specific example. In this case, it is supposed that the charged composition $Y_{R32}$ of R32 in the refrigerant mixture is 44 wt %. It is also supposed that the detection value $P_1$ detected by the first pressure detecting device 30 is 2.7 $MPa_{abs}$, and the detection value $P_2$ detected by the second pressure detecting device 31 is 0.70 $MPa_{abs}$. Further, it is supposed that the detection value $T_1$ detected by the first temperature detecting device 32 is 45° C., and the detection value $T_2$ detected by the second temperature detecting device 33 is 2° C. For calculation of physical property values described below, values described in REFPROP Version9.0 sold by the National Institute of Standards and Technology (NIST) are used (the same applies hereinafter).

First, in step B1, the detection value $P_1$=2.7 $MPa_{abs}$ is read from the first pressure detecting device 30, the detection value P2=0.70 $MPa_{abs}$ is read from the second pressure detecting device 31, the detection value $T_1$=45° C. is read from the first temperature detecting device 32, and the detection value $T_2$=2° C. is read from the second temperature detecting device 33. Further, the charged composition $Y_{R32}$=44 wt % is read in step B2. Next, in step B3, the high-pressure supercooled liquid enthalpy $F_1$ is calculated from the detection value $T_1$=45° C. detected by the first temperature detecting device 32, the detection value $P_1$=2.7 $MPa_{abs}$ detected by the first pressure detecting device 30, and the charged composition $Y_{R32}$=44 wt %. At this time, the high-pressure supercooled liquid enthalpy $F_1$ becomes equal to 196 kJ/kg. The high-pressure supercooled liquid enthalpy $F_1$ corresponds to the enthalpy at point B in the p-h diagram illustrated in FIG. 7.

Next, in step B4, the high-pressure saturated liquid enthalpy $F_{L1}$ is calculated from the detection value $P_1$=2.7 $MPa_{abs}$ detected by the first pressure detecting device 30 and the detection value of the charged composition $Y_{R32}$=44 wt %. At this time, the high-pressure saturated liquid enthalpy $F_{L1}$ becomes equal to 207 kJ/kg. The high-pressure saturated liquid enthalpy $F_{L1}$ corresponds to the enthalpy at point A in the p-h diagram illustrated in FIG. 7.

Next, in step B5, the supercooled liquid enthalpy $F_1$=196 kJ/kg is assigned into the enthalpy $F_2$ of the low-pressure refrigerant. The enthalpy $F_2$ of the low-pressure refrigerant corresponds to the enthalpy at point C in the p-h diagram illustrated in FIG. 7. Next, in step B6, the low-pressure saturated liquid enthalpy $F_{L2}$ is calculated from the detection value $P_{2=0.70}$ $MPa_{abs}$ detected by the second pressure detecting device 31, and the charged composition $Y_{R32}$=44 wt %. At this time, the low-pressure saturated liquid enthalpy $F_{L2}$ becomes equal to 120 kJ/kg. The low-pressure saturated liquid enthalpy $F_{L2}$ corresponds to the enthalpy at point D in the p-h diagram illustrated in FIG. 7.

Next, in step B7, the supercooled liquid enthalpy $F_1$ and the high-pressure saturated liquid enthalpy $F_{L1}$ are compared with each other. Further, the enthalpy $F_2$ of the low-pressure refrigerant and the low-pressure saturated liquid enthalpy $F_{L2}$ are compared with each other. In this example, $F_1$=196 kJ/kg<$F_{L1}$=207 kJ/kg, and $F_2$=207 kJ/kg>$F_{L2}$=120 kJ/kg. Therefore, it is determined that the determination condition is satisfied, and the processing proceeds to step B8. In step B8, the composition computation result is determined as "correct".

When the composition determining function unit 40B determines whether or not the composition computation result of the composition computing function unit 40A is correct, the determination is performed by using the charged composition $Y_i$ of the refrigerant mixture. Therefore, the computation result of enthalpies used in the determination formula include errors against a case where the actual circulating composition is used, and measurement errors introduced by the pressure detecting devices and the temperature detecting devices. For this reason, there is a possibility that the computation result of the composition computing function unit 40A may be determined as correct even through the computation result is actually incorrect. Accordingly, it is possible to reduce the possibility of erroneous composition detection by adding a margin for error to the determination formula used for the correct/incorrect determination performed by the composition determining function unit 40B.

For example, the determination formula $F_1<F_{L1}$ and $F_2>F_{L2}$ with no margin added is changed to the following form: $F_1<F_{L1}\times\alpha$ and $F_2>F_{L2}\times\beta$. At this time, $\alpha$ and $\beta$ are margins on the high-pressure side and the low-pressure side, respectively. By defining $\alpha$ and $\beta$ as such values that $\alpha<1$ and $\beta>1$, point A in FIG. 7 is moved to the left side, and point D is moved to the right side, thereby enabling more rigorous and stable correct/incorrect determination of the composition computation result.

Setting too small a value as the margin $\alpha$ on the high-pressure side increases the region in which the composition computation result is determined as incorrect even through the computation result is correct. Further, setting too large a value as the margin $\beta$ on the low-pressure side increases the region in which the composition computation result is determined as incorrect even through the computation result is correct. Therefore, the respective values of the margins $\alpha$ and $\beta$ on the high-pressure side and the low-pressure side need to be determined by taking into account errors due to the composition, errors due to the temperature detecting devices, and errors due to the pressure detecting devices. For example, in a case where the errors in enthalpy computation due to the composition, the temperature detecting devices, and the pressure detecting devices are each estimated to be 1%, it is preferable to set $\alpha=0.97$ and $\beta=1.03$.

Next, a description will be given of an example of how to compute each enthalpy on the basis of the result obtained by the composition computing function unit 40A and the result obtained by the composition determining function unit 40B. To compute an enthalpy, data representing the relationship between temperature, composition, and supercooled liquid enthalpy, data representing the relationship between pressure, composition, and saturated liquid enthalpy, and data representing the relationship between temperature, pressure, composition, and enthalpy are each previously stored in a table format in storage means (not illustrated) included in the controller 40. Then, it is preferable to employ such a method that allows an enthalpy to be derived from a composition and a detection value of each detecting device. In this regard, as can be appreciated from the p-h diagram of a refrigerant mixture in FIG. 4, the isothermal line in the supercooled state is substantially parallel to the axis that represents pressure. This indicates a characteristic that the temperature does not vary significantly with varying pressure. Accordingly, as for the data representing the relationship between temperature, composition, and supercooled liquid enthalpy, by creating a simplified table in advance so that its value becomes the same irrespective of pressure, the data size can be reduced. Further, the stored data about the relationship between temperature, pressure, and composition may be interpolated as required to thereby compute enthalpy.

Figure 8:
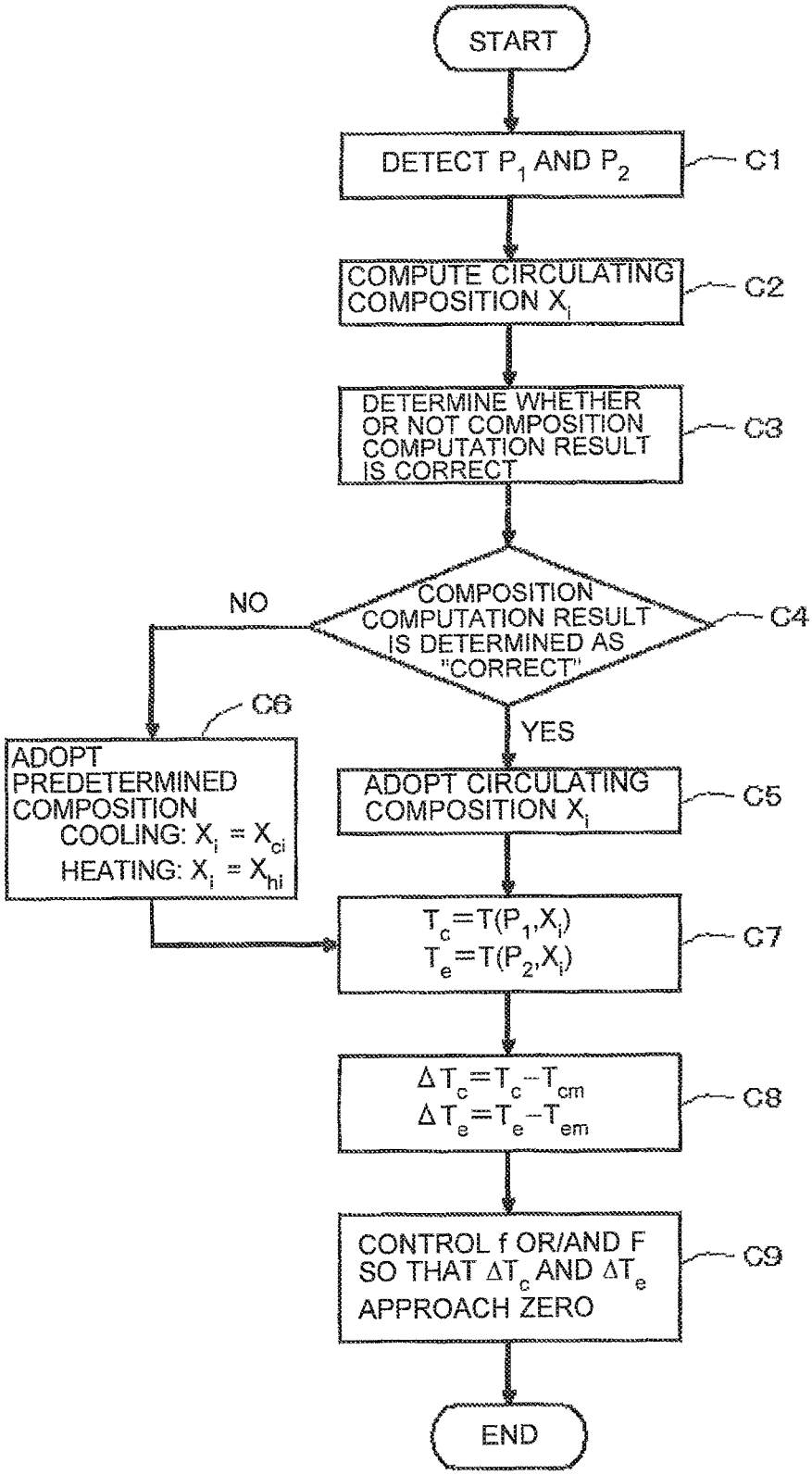
FIG. 8 is a flowchart illustrating processing of a control operation of a controller 40.

FIG. 8 is a flowchart illustrating processing of a control operation of the controller 40. A control operation of devices executed by the controller 40 according to Embodiment 1 will be described. First, in step C1, detection values $P_1$ and $P_2$ respectively detected by the first pressure detecting device 30 and the second pressure detecting device 31 are read. Next, in step C2, as previously described, a circulating composition $X_i$ is computed by the composition computing function unit 40A.

Further, in step C3, as previously described, a correct/incorrect determination with respect to the composition computation result is performed by the composition determining function unit 40B. Then, in step C4, it is determined whether or not the correct/incorrect determination result with respect to the composition computation result is "correct". If it is determined that the correct/incorrect determination result with respect to the composition computation result is "correct", the computed circulating composition $X_i$ is adopted as correct (step C5). On the other hand, if it is determined that the correct/incorrect determination result with respect to the composition computation result is "incorrect", the computed circulating composition $X_i$ is determined as not reflecting the actual circulating composition. Then, a predetermined value (cooling operation mode: $X_{ci}$, heating operation mode: $X_{hi}$) previously set in accordance with the operation mode is adopted as the circulating composition $X_i$ (step C6). In this regard, in cooling operation mode, refrigerant accumulates in the outdoor-side heat exchanger 12, and surplus refrigerant is unlikely to accumulate in the accumulator 13, with the result that the circulating composition during operation becomes close to the charged composition $Y_i$. Accordingly, the predetermined value $X_{ci}$ for the cooling operation mode is set as the charged composition $Y_i$. In heating operation mode, the amount of refrigerant that accumulates in the load-side heat exchanger 50 is small, and surplus refrigerant accumulates in the accumulator 13, with the result that the circulating composition during operation contains a large proportion of low boiling point components. Accordingly, the predetermined value $X_{hi}$ for the heating operation mode is set to such a value that the resulting composition contains a larger proportion of components with low boiling points than does the charged composition $Y_i$.

Next, in step C7, a condensing temperature $T_c$ is computed from the circulating composition $X_i$ and the detection value $P_1$ detected by the first pressure detecting device 30. Further, an evaporating temperature $T_e$ is computed from the circulating composition $X_i$ and the detection value $P_2$ detected by the second pressure detecting device 31. At this time, in calculation of the condensing temperature $T_c$ and the evaporating temperature $T_e$, data representing the relationship between pressure, composition, and saturation temperature may be stored in storage means (not illustrated) in advance so that a saturation temperature can be derived from a composition and a value detected by a pressure detecting device.

Next, in step C8, $\Delta T_c$, which is a value obtained by subtracting a target value $T_{cm}$ of condensing temperature from the condensing temperature $T_c$, and $\Delta T_e$, which is a value obtained by subtracting a target value $T_{em}$ of evaporating temperature from the evaporating temperature $T_e$, are calculated. At this time, the values calculated in step C7 are used as the condensing temperature $T_c$ and the evaporating temperature $T_e$. Further, for the target value $T_{cm}$ of condensing temperature and the target value $T_{em}$ of evaporating temperature, values stored as data in storage means (not illustrated) in accordance with the outdoor temperature and the indoor temperature are used.

Next, in step C9, the frequency f of the compressor 10 and the rotation speed F of the outdoor fan 12A are controlled so that $\Delta T_c$ and $\Delta T_e$ approach 0 (zero). For example, in a case where the outdoor-side heat exchanger 12 serves as a condenser, when $\Delta T_c$ has a positive value, the frequency f of the compressor 10 is controlled so as to become lower, or/and the rotation speed F of the outdoor fan 12A is controlled so as to become higher. When $\Delta T_c$ has a negative value, the frequency f of the compressor 10 is controlled so as to become higher, or/and the rotation speed F of the outdoor fan 12A is controlled so as to become lower. In a case where, for example, the outdoor-side heat exchanger 12 serves as an evaporator, when $\Delta T_e$ has a positive value, the frequency f of the compressor 10 is controlled so as to become higher, or/and the rotation speed F of the outdoor fan 12A is controlled so as to become lower. When $\Delta T_e$ has a negative value, the frequency f of the compressor 10 is controlled so as to become lower, or/and the rotation speed F of the outdoor fan 12A is controlled so as to become higher.

As described above, with the air-conditioning apparatus according to Embodiment 1, in the controller 40, the composition determining function unit 40B evaluates the computation result of the composition computing function unit 40A, and if it is determined that the computation result is not appropriate, the composition determining function unit 40B adopts a previously set predetermined value as the circulating composition $X_i$. Therefore, a control based on an appropriate circulating composition can be performed, thereby making it possible to obtain an air-conditioning apparatus with good operational efficiency. As a result, energy saving can be achieved. At this time, the predetermined value $X_{ci}$ for cooling operation and the predetermined value $X_{hi}$ for heating operation are set independently, thereby enabling a control based on a more appropriate circulating composition.

Embodiment 2

Next, the air-conditioning apparatus 100 according to Embodiment 2 of the present invention will be described. Here, differences from Embodiment 1 will be mainly described. The configuration of the air-conditioning apparatus 100 according to Embodiment 2 is the same as that according to Embodiment 1. The air-conditioning apparatus 100 according to Embodiment 2 differs from the air-conditioning apparatus 100 according to Embodiment 1 in the processing executed in the composition determining function unit 40B of the controller 40.

In Embodiment 2, with regard to the composition determining function unit 40B, the saturation temperature on each of the high-pressure side and the low-pressure side is calculated. Then, the relative magnitudes of the calculated value of saturated liquid temperature, the detection value $T_1$ detected by the first temperature detecting device 32, and the detection value $T_2$ detected by the second temperature detecting device 33 are compared with each other to thereby determine whether or not the circulating composition computed in the composition computing function unit 40A is correct.

Figure 9:
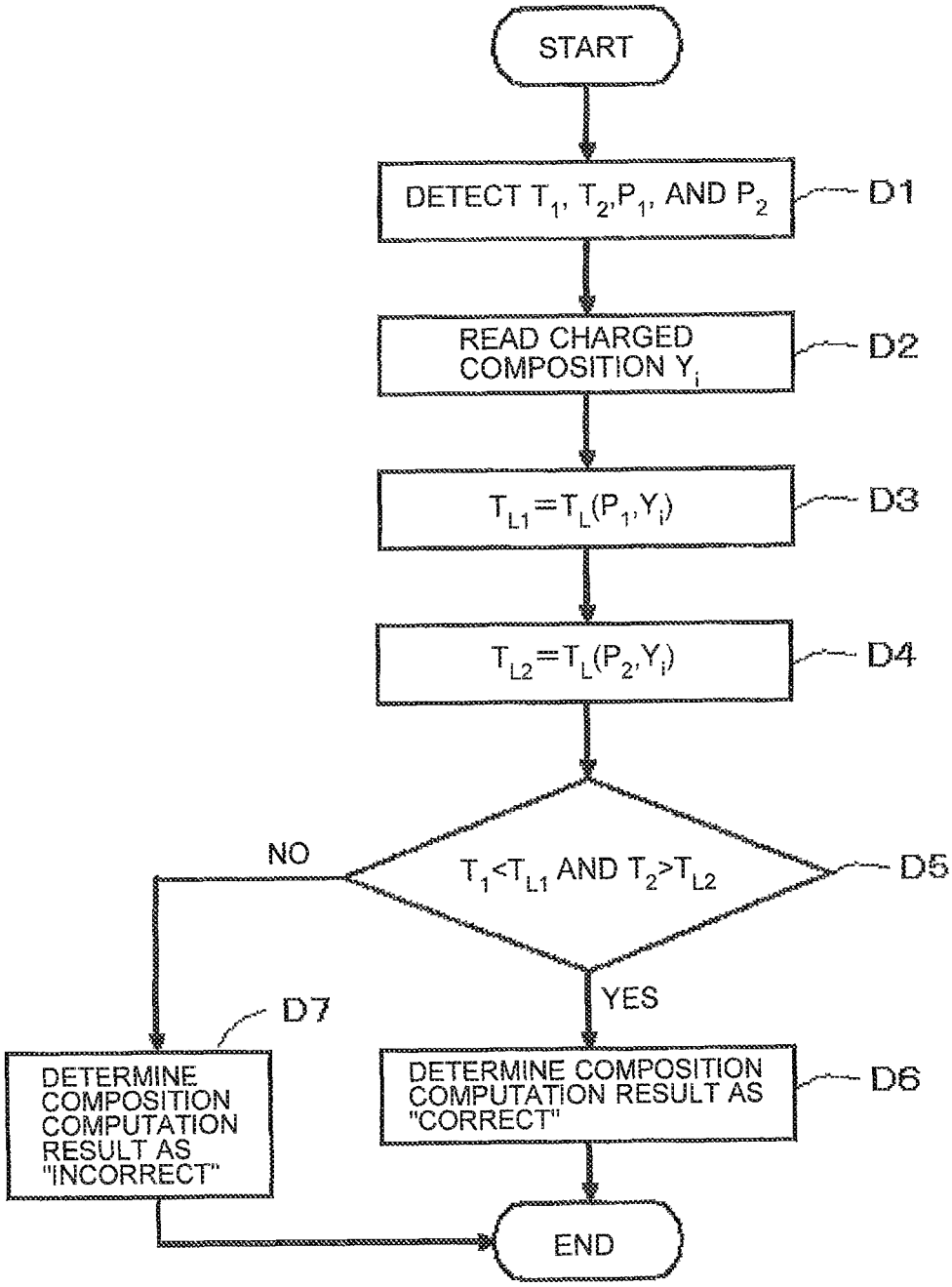
FIG. 9 is a flowchart illustrating a procedure of processing in the composition determining function unit 40B according to Embodiment 2 of the present invention.

FIG. 9 is a flowchart illustrating a procedure of processing in the composition determining function unit 40B according to Embodiment 2. Next, operation of the composition determining function unit 40B according to Embodiment 2 will be described. First, in step D1, detection values $T_1$, $T_2$, $P_1$, and $P_2$ are read from the first temperature detecting device 32, the second temperature detecting device 33, the first pressure detecting device 30, and the second pressure detecting device 31, respectively. Next, in step D2, the charged composition $Y_i$ of a refrigerant mixture, which is set to a predetermined value and stored in advance, is read. At this time, the suffix "i" indicates that the composition in question relates to the component of the type "i" of the refrigerant mixture.

Next, in step D3, a high-pressure saturated liquid temperature $T_{L1}$ in the portion upstream of the second expansion device 24 is computed from the charged composition $Y_i$ read in step D2, and the detection value $P_1$ detected by the first pressure detecting device 30. Further, in step D4, a low-pressure saturated liquid temperature $T_{L2}$ in the portion downstream of the second expansion device 24 is computed from the charged composition $Y_i$ read in step D2, and the detection value $P_2$ detected by the second pressure detecting device 31.

Next, in step D5, it is determined whether or not the detection value $T_1$ detected by the first temperature detecting device 32 is less than the high-pressure saturated liquid temperature $T_{L1}$, and the detection value $T_2$ detected by the second temperature detecting device 33 is greater than the low-pressure saturated liquid temperature $T_{L2}$. If it is determined that the above-mentioned determination condition is satisfied, the composition computation result is determined as "correct" (step D6). If it is determined that the above-mentioned determination condition is not satisfied, the composition computation result is determined as "incorrect" (step D7).

Now, with regard to operation of the composition determining function unit 40B according to Embodiment 2, the high-pressure saturated liquid temperature $T_{L1}$ in step D3 is calculated by Equation (6) below. The low-pressure saturated liquid temperature $T_{L2}$ in step D4 is calculated by Equation (7) below.

$$T_{L1}=T_L(P_1,Y_i) \tag{6}$$

$$T_{L2}=T_L(P_2,Y_i) \tag{7}$$

Figure 10:
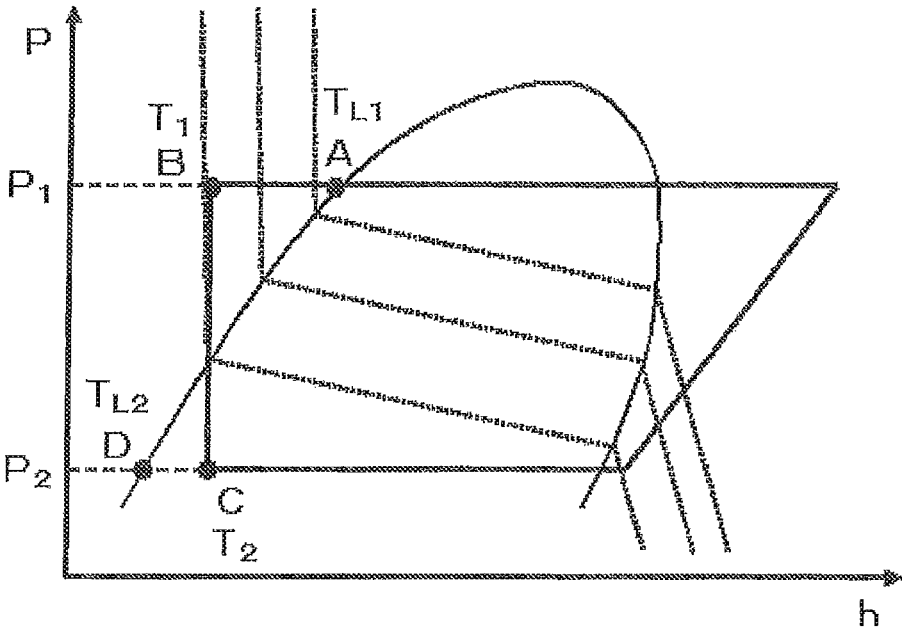
FIG. 10 is a p-h diagram for explaining processing in the composition determining function unit 40B according to Embodiment 2.

FIG. 10 is a p-h diagram for explaining processing in the composition determining function unit 40B according to Embodiment 2. The processing in the composition determining function unit 40B of the controller 40 according to Embodiment 2 described above will be described on the basis of a specific example. In this case, it is supposed that the charged composition $Y_{R32}$ of R32 in the refrigerant mixture is 44 wt %. It is also supposed that the detection value $P_1$ detected by the first pressure detecting device 30 is 2.7 $MPa_{abs}$, and the detection value $P_2$ detected by the second pressure detecting device 31 is 0.70 $MPa_{abs}$. Further, it is supposed that the detection value $T_1$ detected by the first temperature detecting device 32 is 45° C., and the detection value $T_2$ detected by the second temperature detecting device 33 is 2° C.

First, in step D1, the detection value $P_1$=2.7 $MPa_{abs}$ is read from the first pressure detecting device 30, the detection value $P_2$=0.70 $MPa_{abs}$ is read from the second pressure detecting device 31, the detection value $T_1$=45° C. is read from the first temperature detecting device 32, and the detection value $T_2$=2° C. is read from the second temperature detecting device 33. At this time, the detection value $T_1$ detected by the first temperature detecting device 32 corresponds to the temperature at point B in the p-h diagram illustrated in FIG. 10. The detection value $T_2$ detected by the second temperature detecting device 33 corresponds to the temperature at point C in FIG. 10. Further, the charged composition $Y_{R32}$=44 wt % is read in step D2.

Next, in step D3, the high-pressure saturated liquid temperature $T_{L1}$ is calculated from the detection value $P_1$=2.7 $MPa_{abs}$ detected by the first pressure detecting device 30 and the detection value of the charged composition $Y_{R32}$=44 wt %. At this time, the high-pressure saturated liquid temperature $T_{L1}$ becomes equal to 50° C. The high-pressure saturated liquid temperature $T_{L1}$ corresponds to the temperature at point A in the p-h diagram illustrated in FIG. 10.

Next, in step D4, the low-pressure saturated liquid temperature $T_{L2}$ is calculated from the detection value $P_2$=0.70 $MPa_{abs}$ detected by the second pressure detecting device 31 and the charged composition $Y_{R32}$=44 wt %. At this time, the low-pressure saturated liquid temperature $T_{L2}$ becomes equal to −1° C. The low-pressure saturated liquid temperature $T_{L2}$ corresponds to the temperature at point D in the p-h diagram illustrated in FIG. 10.

Next, in step D5, the detection value $T_1$ detect by the first temperature detecting device 32 and the high-pressure saturated liquid temperature $T_{L1}$ are compared with each other. Further, the detection value $T_2$ detect by the second temperature detecting device 33 and the low-pressure saturated liquid temperature $T_{L2}$ are compared with each other. In this example, $T_1$=45° C.<$T_{L1}$=50° C., and $T_2$=2° C.>$T_{L2}$=−1° C. Therefore, it is determined that the determination condition in step D5 is satisfied, and the processing proceeds to step D6. In step D6, the composition computation result is determined as "correct".

In this regard, in Embodiment 2, as in Embodiment 1, it is possible to reduce the possibility of erroneous composition detection by adding a margin for error to the determination formula used for the correct/incorrect determination performed by the composition determining function unit 40B.

For example, the determination formula $T_1<T_{L1}$ and $T_2>T_{L2}$ with no margin added is changed to the following form: $T_1<T_{L1}\times\alpha$ and $T_2>T_{L2}\times\beta$. At this time, α and β are margins on the high-pressure side and the low-pressure side, respectively. By defining α and β as such values that α<1 and β>1, point A in FIG. 10 is moved to the left side, and point D is moved to the right side, thereby enabling more rigorous and stable correct/incorrect determination of the composition computation result.

Setting too small a value as the margin α on the high-pressure side increases the region in which the composition computation result is determined as incorrect even through the computation result is correct. Further, setting too large a value as the margin β on the low-pressure side increases the region in which the composition computation result is determined as incorrect even through the computation result is correct. Therefore, the respective values of the margins α and β on the high-pressure side and the low-pressure side need to be determined by taking errors due to the composition, errors due to the temperature detecting devices, and errors due to the pressure detecting devices into account.

As described above, with the air-conditioning apparatus 100 according to Embodiment 2, the composition determining function unit 40B evaluates the computation result of the composition computing function unit 40A on the basis of the high-pressure saturated liquid temperature $T_{L1}$ and the low-pressure saturated liquid temperature $T_{L2}$. Therefore, processing steps can be reduced, thereby enabling a control based on the circulating composition more easily.

Embodiment 3

Next, the air-conditioning apparatus 100 according to Embodiment 3 of the present invention will be described. Here, differences from Embodiment 1 and Embodiment 2 will be mainly described. The configuration of the air-conditioning apparatus 100 according to Embodiment 2 is the same as that according to Embodiment 1. The air-conditioning apparatus 100 according to Embodiment 3 differs from the air-conditioning apparatus 100 according to Embodiment 1 in the processing related to determination executed in the composition determining function unit 40B of the controller 40.

In Embodiment 3, the quality of refrigerant in each of the portions upstream and downstream of the second expansion device 24 is calculated by using detection values detected by the first pressure detecting device 30, the second pressure detecting device 31, the first temperature detecting device 32, and the second temperature detecting device 33, and the charged composition $Y_i$ of refrigerant. Then, whether or not the computed circulating composition of refrigerant is correct is determined by determining whether the state of the refrigerant is a two-phase state or a liquid state.

Figure 11:
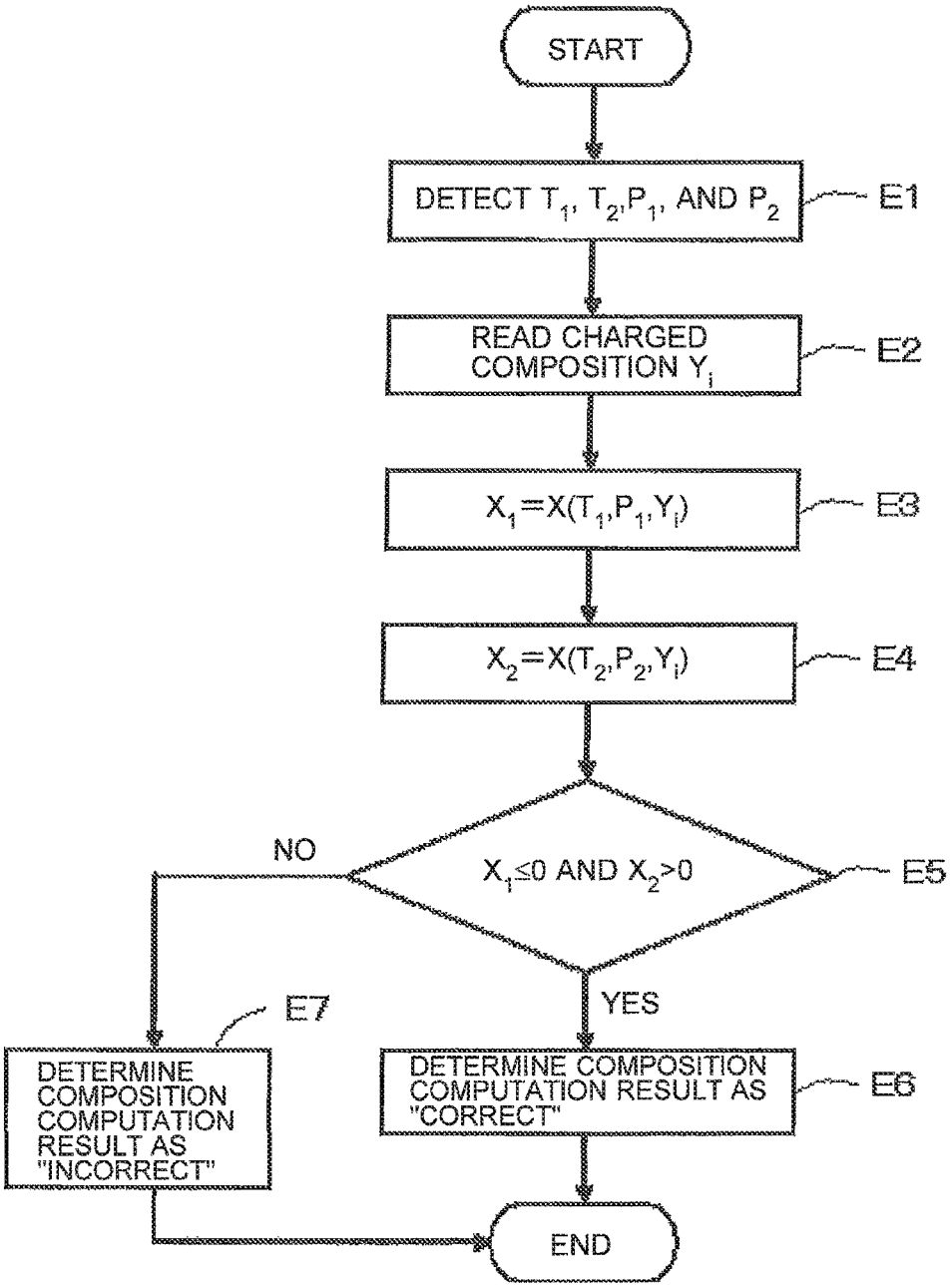
FIG. 11 is a flowchart illustrating a procedure of processing in the composition determining function unit 40B according to Embodiment 3 of the present invention.

FIG. 11 is a flowchart illustrating a procedure of processing in the composition determining function unit 40B according to Embodiment 3. Next, operation of the composition determining function unit 40B according to Embodiment 3 will be described. First, in step E1, the respective detection values $T_1$, $T_2$, $P_1$, and $P_2$ detected by the first temperature detecting device 32, the second temperature detecting device 33, the first pressure detecting device 30, and the second pressure detecting device 31 are read. Next, in step E2, the charged composition $Y_i$ of a refrigerant mixture, which is set to a predetermined value and stored in advance, is read. At this time, the suffix "i" indicates that the composition in question relates to the component of the type "i" of the refrigerant mixture.

Next, in step E3, the quality $X_1$ of refrigerant in the portion upstream of the second expansion device 24 is computed from the charged composition $Y_i$ read in step E2, the detection value $T_1$ detected by the first temperature detecting device 32, and the detection value $P_1$ detected by the first pressure detecting device 30. Further, in step E4, the quality $X_2$ of refrigerant in the portion downstream of the second expansion device 24 is computed from the charged composition $Y_i$ read in step E2, the detection value $T_2$ detected by the second temperature detecting device 33, and the detection value $P_2$ detected by the second pressure detecting device 31.

Next, in step E5, it is determined whether or not the quality $X_1$ of refrigerant in the portion upstream of the second expansion device 24 is less than or equal to 0, and the quality $X_2$ of refrigerant in the portion downstream of the second expansion device 24 is greater than 0. If it is determined that the above-mentioned determination condition is satisfied, the composition computation result is determined as "correct" (step E6). If it is determined that the above-mentioned determination condition is not satisfied, the composition computation result is determined as "incorrect" (step E7).

At this time, the quality $X_1$ of refrigerant in the portion upstream of the second expansion device 24 is calculated by Equation (8) below. The quality $X_2$ of refrigerant in the portion downstream of the second expansion device 24 is calculated by Equation (9) below. A high-pressure saturated gas enthalpy $F_{G1}$ included in each of Equation (8) and Equation (9) is calculated from Equation (10) from the detection value $P_1$ detected by the first pressure detecting device 30 and the charged composition $Y_i$ of the refrigerant mixture. Further, a low-pressure saturated gas enthalpy $F_{G2}$ is calculated from Equation (11) from the detection value $P_2$ detected by the second pressure detecting device 31 and the charged composition $Y_i$ of the refrigerant mixture. The definitions of the other enthalpies are as described above with reference to Embodiment 1.

$$X_1=(F_1-F_{L1})/(F_{G1}-F_{L1}) \quad (8)$$

$$X_2=(F_2-F_{L2})/(F_{G2}-F_{L2}) \quad (9)$$

$$F_{G1}=H_q(P_1,Y_i) \quad (10)$$

$$F_{G2}=H_q(P_2,Y_i) \quad (11)$$

Figure 12:
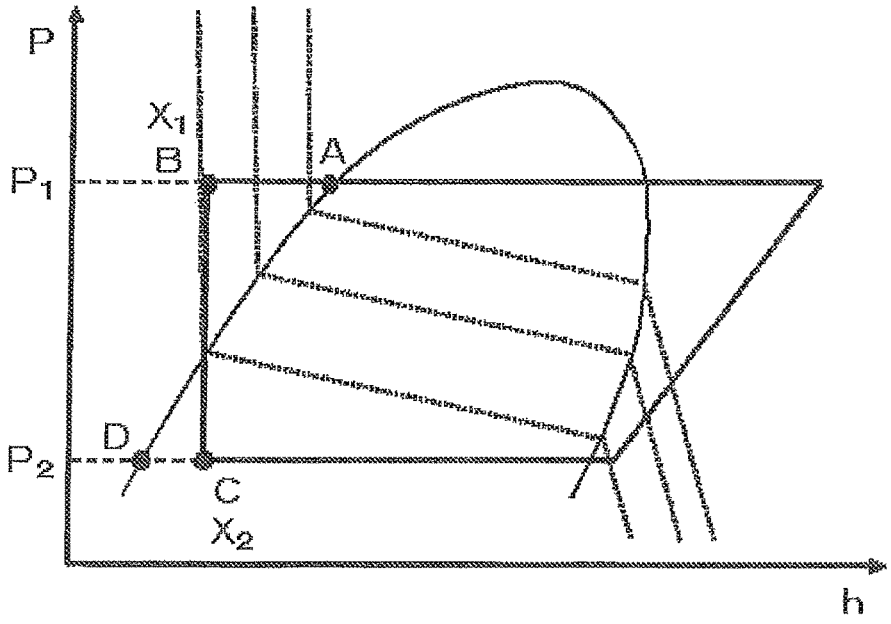
FIG. 12 is a p-h diagram for explaining processing in the composition determining function unit 40B according to Embodiment 2.

FIG. 12 is a p-h diagram for explaining processing in the composition determining function unit 40B according to Embodiment 2. The processing in the composition determining function unit 40B of the controller 40 according to Embodiment 3 described above will be described on the basis of a specific example. In this case, it is supposed that the charged composition $Y_{R32}$ of R32 in the refrigerant mixture is 44 wt %. It is also supposed that the detection value $P_1$ detected by the first pressure detecting device 30 is 2.7 $MPa_{abs}$, and the detection value $P_2$ detected by the second pressure detecting device 31 is 0.70 $MPa_{abs}$. Further, it is supposed that the detection value $T_1$ detected by the first temperature detecting device 32 is 45° C., and the detection value $T_2$ detected by the second temperature detecting device 33 is 2° C.

First, in step E1, the detection value $P_1$=2.7 $MPa_{abs}$ is read from the first pressure detecting device 30, the detection value $P_2$=0.70 $MPa_{abs}$ is read from the second pressure detecting device 31, the detection value $T_1$=45° C. is read from the first temperature detecting device 32, and the detection value $T_2$=2° C. is read from the second temperature detecting device 33. Further, the charged composition $Y_{R32}$=44 wt % is read in step D2.

Next, in step E3, the quality $X_1$ of refrigerant in the portion upstream of the second expansion device 24 is calculated from the detection value $T_1$=45° C. detected by the first temperature detecting device 32, the detection value $P_1$=2.7 $MPa_{abs}$ detected by the first pressure detecting device 30, and the charged composition $Y_{R32}$=44 wt %. At this time, the quality $X_1$ becomes equal to −0.08. The quality $X_1$ of refrigerant in the portion upstream of the second expansion device 24 corresponds to point B in the p-h diagram illustrated in FIG. 12.

Further, in step E4, the quality $X_2$ of refrigerant in the portion downstream of the second expansion device 24 is calculated from the detection value $T_2$=2° C. detected by the second temperature detecting device 33, the detection value $P_2$=0.70 $MPa_{abs}$ detected by the second pressure detecting device 31, and the charged composition $Y_{R32}$=44 wt %. At this time, the quality $X_2$ becomes equal to −0.35. The quality $X_2$ of refrigerant in the portion downstream of the second expansion device 24 corresponds to point C in the p-h diagram illustrated in FIG. 12.

Then, in step E5, it is determined whether or not the quality $X_1$ of refrigerant in the portion upstream of the second expansion device 24 is less than or equal to 0, and the quality $X_2$ of refrigerant in the portion downstream of the second expansion device 24 is greater than 0. In this example, the quality $X_1$=−0.08≤0 and the quality $X_2$=−0.35>0. Therefore, it is determined that the determination condition in step E5 is satisfied, and the processing proceeds to step E6. In step E6, the computation result is determined as "correct".

In this regard, in Embodiment 3, as in Embodiments 1 and 2, it is possible to reduce the possibility of erroneous composition detection by adding a margin for error to the determination formula used for the correct/incorrect determination performed by the composition determining function unit 40B.

For example, the determination formula $X_1<0$ and $X_2>0$ with no margin added is changed to the following form: $X_1<0+\alpha$ and $X_2>0+\beta$. At this time, α and β are margins on the high-pressure side and the low-pressure side, respectively. By defining α and β as such values that α<0 and β>0, point A in FIG. 10 is moved to the left side, and point D is moved to the right side, thereby enabling more rigorous and stable correct/incorrect determination of the composition computation result.

Setting too small a value as the margin α on the high-pressure side increases the region in which the composition computation result is determined as incorrect even through the computation result is correct. Further, setting too large a value as the margin β on the low-pressure side increases the region in which the composition computation result is determined as incorrect even through the computation result is correct. Therefore, the respective values of the margins α and β on the high-pressure side and the low-pressure side need to be determined by taking errors due to the composition, errors due to the temperature detecting devices, and errors due to the pressure detecting devices into account.

As described above, with the air-conditioning apparatus 100 according to Embodiment 3, the composition determining function unit 40B evaluates the computation result of the composition computing function unit 40A on the basis of the qualities of refrigerant $X_1$ and $X_2$ in the portions upstream and downstream of the second expansion device 24, respectively. Therefore, processing steps can be reduced, thereby enabling a control based on the circulating composition more easily.

Embodiment 4

For example, in the air-conditioning apparatus 100 illustrated in FIG. 1, a single indoor unit 2 and the outdoor unit 1 are connected via the refrigerant main pipe 3. However, the number of indoor units 2 to be connected is not limited to one but a plurality of indoor units 2 may be connected.

Further, a system in which a plurality of indoor units 2 are connected is not limited to a system in which all of the indoor units 2 connected perform cooling or heating operation but may be a system that performs mixed operation in which each individual indoor unit 2 performs cooling operation and heating operation simultaneously.

A plurality of outdoor units 1 may be connected, in which case a representative outdoor unit 1 may be determined.

While the air-conditioning apparatus 100 according to Embodiment 1 and the like mentioned above is directed to the case of a direct expansion circuit in which the outdoor unit 1 and the indoor unit 2 are connected in series by the refrigerant main pipe 3, this should not be construed restrictively. For example, the air-conditioning apparatus 100 includes a heat medium relay unit provided at a position spaced apart from the outdoor unit 1. The heat medium relay unit includes an intermediate heat exchanger that exchanges heat between a refrigerant mixture and a heat medium different from the refrigerant mixture, and the first expansion device 51. Further, the air-conditioning apparatus may be configured so that a heat medium that is heated or cooled through heat exchange with the refrigerant is circulated through the load-side heat exchanger 50.

While Embodiment 1 and the like mentioned above are directed to the case of a refrigerant in which an R32 refrigerant and an R1234yf refrigerant are mixed at mass ratios of 44 wt % and 56 wt %, this should not be construed restrictively. As long as the zeotropic refrigerant mixture used is such that a plurality of refrigerants are mixed and the saturated gas temperature and the saturated liquid temperature at the same pressure are different, the same effect is obtained even if the kinds and mixing ratios of the refrigerants to be mixed differ from those of the refrigerant mixture described with reference to the embodiments mentioned above.

While Embodiment 1 and the like mentioned above are directed to the case where the outdoor unit 1 has a single compressor 10, the outdoor unit 1 may have a plurality of compressors.

While Embodiment 1 and the like mentioned above are directed to the case where the outdoor unit 1 has a single accumulator 13, the outdoor unit 1 may have a plurality of accumulators 13. Further, for example, in the air-conditioning apparatus 100 to which a plurality of indoor units 2 are connected, the circulating composition of a refrigerant mixture flowing through a refrigerant circuit may sometimes change for reasons such as the refrigerant accumulating in the indoor unit 2 that has stopped. Accordingly, the same effect is obtained even in a case where the outdoor unit 1 is not equipped with the accumulator 13.

While Embodiment 1 and the like mentioned above are directed to the case of the air-conditioning apparatus 100 having the refrigerant flow switching device 11 provided in the outdoor unit 1, the present invention can be also applied to the air-conditioning apparatus 100 that does not include the refrigerant flow switching device 11 and performs only one of cooling operation and heating operation.

While Embodiment 1 and the like mentioned above are directed to the case of the air-conditioning apparatus 100 having the composition detection circuit 20 provided in the outdoor unit 1, this should not be construed restrictively. The composition detection circuit 20 may not necessarily be provided as long as there are detecting devices that detect a high-pressure side pressure that is a pressure on the upstream side of the first expansion device 51, a low-pressure side pressure that is a pressure on the downstream side of the first expansion device 51, a temperature on the high-pressure side upstream of the first expansion device 51 (the temperature of a supercooled liquid refrigerant), and the temperature of refrigerant on the low-pressure side downstream of the first expansion device 51.

For example, the low-pressure side pressure as a pressure on the downstream side of the first expansion device 51 can be substituted for by a value close to the low-pressure side pressure. For example, the pressure on the suction side of the compressor 10, or the pressure on the suction side of the accumulator 13 may be used instead.

REFERENCE SIGNS LIST

1 outdoor unit, 2 indoor unit, 3 refrigerant main pipe, 4 refrigerant pipe, 10 compressor, 11 refrigerant flow switching device, 12 outdoor-side heat exchanger, 13 accumulator, 20 composition detection circuit, 21 first pipe, 22 second pipe, 23 composition detection heat exchanger, 24 second expansion device, 30 first pressure detecting device, 31 second pressure detecting device, 32 first temperature detecting device, 33 second temperature detecting device, 40 controller, 40A composition computing function unit, 40B composition determining function unit, 50 load-side heat exchanger, 51 first expansion device, 60 third temperature detecting device, 61 fourth temperature detecting device, 62 fifth temperature detecting device, 100 air-conditioning apparatus

The invention claimed is:

1. An air-conditioning apparatus comprising:

a refrigerant circuit that is formed by connecting, by a refrigerant pipe, a compressor that discharges a refrigerant, which is a zeotropic refrigerant mixture including a plurality of components with different boiling points, an outdoor-side heat exchanger that exchanges heat between air outside an air-conditioning target space and the refrigerant, a first expansion device that regulates a pressure of the refrigerant, and a load-side heat exchanger that exchanges heat between air in the air-conditioning target space and the refrigerant; and, a controller that includes a processor and a memory, wherein the processor is configured to execute a program stored in the memory to:

compute, by a composition computing function unit, a circulating composition, wherein the circulating composition represents a value of composition of each of the plurality of components with different boiling points in the refrigerant circulating through the refrigerant circuit; and determine, by a composition determining function unit, whether or not a computation result of the composition computing function unit is correct, responsive to determining that the computation result is incorrect, adopt a pre-determined value, based on an operation mode of the air-conditioning apparatus, of the composition of each of the plurality of components, the pre-determined value being set in advance and related to composition as the circulating composition, and responsive to determining that the computation result is correct, adopt the computation result as the circulating composition, set, as the pre-determined value of the composition of each of the plurality of components which is used responsive to determining that the computation result is incorrect, (a) a value of the composition of each of the plurality of components to be used in a cooling operation and (b) a value of the composition of each of the plurality of components to be used in a heating operation, wherein (a) the pre-determined value of the composition of each of the plurality of components to be used in the cooling operation is a value equal to composition of the refrigerant charged into the refrigerant circuit; and (b) the pre-determined value of the composition of each of the plurality of components to be used in the heating operation is a value that among the plurality of components, a proportion of a component with a low boiling point is greater than in the composition of the refrigerant charged into the refrigerant circuit.

2. The air-conditioning apparatus of claim 1, further comprising:

a supercooled liquid temperature detecting device that detects a supercooled liquid refrigerant temperature, the supercooled liquid refrigerant temperature being a temperature of the refrigerant in a supercooled liquid state on a high-pressure side in the refrigerant circuit;

a high-pressure side pressure detecting device that detects a high-pressure side pressure of the refrigerant in the supercooled liquid state;

a two-phase refrigerant temperature detecting device that detects a two-phase refrigerant temperature, the two-phase refrigerant temperature being a temperature of the refrigerant in a two-phase state obtained after the refrigerant in the supercooled liquid state is reduced in pressure; and a low-pressure side pressure detecting device that detects a low-pressure side pressure of the refrigerant obtained after the refrigerant in the supercooled liquid state is reduced in pressure, wherein the composition computing function unit computes the circulating composition on a basis of the supercooled liquid refrigerant temperature, the two-phase refrigerant temperature, and the low-pressure side pressure, and wherein the composition determining function unit determines whether or not the computation result of the composition computing function unit is correct on a basis of the supercooled liquid refrigerant temperature, the high-pressure side pressure, the two-phase refrigerant temperature, and the low-pressure side pressure.

3. The air-conditioning apparatus of claim 2, wherein the composition determining function unit:

computes a high-pressure supercooled liquid refrigerant enthalpy from a previously stored relationship of pressure, temperature, and composition of the refrigerant to supercooled liquid enthalpy, the supercooled liquid refrigerant temperature, the high-pressure side pressure, and composition of the refrigerant at charge;

treats the high-pressure supercooled liquid refrigerant enthalpy as being equal to a low-pressure two-phase refrigerant enthalpy;

computes a high-pressure saturated liquid enthalpy and a low-pressure saturated liquid enthalpy on a basis of a previously determined relationship of pressure and composition of the refrigerant to saturated liquid enthalpy, the high-pressure side pressure, the low-pressure side pressure, and the composition of the refrigerant at charge; and determines the computation result of the composition computing function unit as correct, if it is determined that the high-pressure supercooled liquid refrigerant enthalpy is less than the high-pressure saturated liquid enthalpy and that the low-pressure two-phase refrigerant enthalpy is greater than the low-pressure saturated liquid enthalpy.

4. The air-conditioning apparatus of claim 2, wherein the composition determining function unit:

computes a high-pressure saturated liquid temperature and a low-pressure saturated liquid temperature, on a basis of a previously determined relationship of pressure and composition of the refrigerant to saturated liquid temperature, the high-pressure side pressure, the low-pressure side pressure, and composition of the refrigerant at charge; and determines the computation result of the composition computing function unit as correct, if it is determined that the supercooled liquid refrigerant temperature is less than the high-pressure saturated liquid temperature and that the two-phase refrigerant temperature is greater than the low-pressure saturated liquid temperature.

5. The air-conditioning apparatus of claim 2, wherein the composition determining function unit:

computes a high-pressure supercooled refrigerant quality from a previously determined relationship of pressure, temperature, and composition of the refrigerant to quality of the refrigerant, the supercooled liquid refrigerant temperature, the high-pressure side pressure, and composition of the refrigerant at charge;

computes a low-pressure two-phase refrigerant quality from the previously determined relationship of pressure, temperature, and composition of the refrigerant to quality of the refrigerant, the two-phase refrigerant temperature, the low-pressure side pressure, and the composition of the refrigerant at charge; and determines the computation result of the composition computing function unit as correct, if it is determined that the high-pressure supercooled refrigerant quality is less than or equal to 0 and that the low-pressure two-phase refrigerant quality is greater than 0.

6. The air-conditioning apparatus of claim 2, wherein the composition determining function unit makes a determination while allowing for a margin to avoid an erroneous determination due to a shift in parameter calculation result, the shift in parameter calculation result being caused by at least one of a difference between the circulating composition computed by the composition computing function unit and the composition of the refrigerant at charge and detection errors introduced by the supercooled liquid temperature detecting device, the high-pressure side pressure detecting device, the two-phase refrigerant temperature detecting device, and the low-pressure side pressure detecting device.

7. The air-conditioning apparatus of claim 2, further comprising:

an outdoor fan that blows outside air to the outdoor-side heat exchanger, wherein the controller controls at least one of a frequency of the compressor and a rotation speed of the outdoor fan on a basis of the circulating composition that is adopted from either the pre-determined value of the composition of each of the plurality of components or the computation result of the composition computing function unit.

8. The air-conditioning apparatus of claim 2, further comprising:

an accumulator that accumulates a surplus refrigerant, the accumulator being provided on a suction side of the compressor within the refrigerant circuit, wherein a composition detection circuit is formed, the composition detection circuit having a first pipe to which a part of the refrigerant discharged by the compressor is bypassed, a second pipe that causes the refrigerant branched to the first pipe to merge with the refrigerant sucked into the compressor, a second expansion device that reduces a pressure of a flow of refrigerant through the first pipe and causes the refrigerant to flow to the second pipe, and a composition detection heat exchanger that exchanges heat between the flow of refrigerant through the first pipe and a flow of refrigerant out of the second expansion device, and wherein the supercooled liquid temperature detecting device, the two-phase refrigerant temperature detecting device, the high-pressure side pressure detecting device, and the low-pressure side pressure detecting device are installed in the composition detection circuit.

9. The air-conditioning apparatus of claim 1, further comprising:

a supercooled liquid temperature detecting device that detects a supercooled liquid refrigerant temperature, the supercooled liquid refrigerant temperature being a temperature of the refrigerant in a supercooled liquid state on a high-pressure side in the refrigerant circuit;

a high-pressure side pressure detecting device that detects a high-pressure side pressure of the refrigerant in the supercooled liquid state;

a two-phase refrigerant temperature detecting device that detects a two-phase refrigerant temperature, the two-phase refrigerant temperature being a temperature of the refrigerant in a two-phase state obtained after the refrigerant in the supercooled liquid state is reduced in pressure; and a low-pressure side pressure detecting device that detects a low-pressure side pressure of the refrigerant obtained after the refrigerant in the supercooled liquid state is reduced in pressure, wherein the composition computing function unit computes the circulating composition on a basis of the supercooled liquid refrigerant temperature, the two-phase refrigerant temperature, and the low-pressure side pressure, and wherein the composition determining function unit determines whether or not the computation result of the composition computing function unit is correct on a basis of the supercooled liquid refrigerant temperature, the high-pressure side pressure, the two-phase refrigerant temperature, and the low-pressure side pressure.

10. The air-conditioning apparatus of claim 9, wherein the composition determining function unit:

computes a high-pressure supercooled liquid refrigerant enthalpy from a previously stored relationship of pressure, temperature, and composition of the refrigerant to supercooled liquid enthalpy, the supercooled liquid refrigerant temperature, the high-pressure side pressure, and composition of the refrigerant at charge;

treats the high-pressure supercooled liquid refrigerant enthalpy as being equal to a low-pressure two-phase refrigerant enthalpy;

computes a high-pressure saturated liquid enthalpy and a low-pressure saturated liquid enthalpy on a basis of a previously determined relationship of pressure and composition of the refrigerant to saturated liquid enthalpy, the high-pressure side pressure, the low-pressure side pressure, and the composition of the refrigerant at charge; and determines the computation result of the composition computing function unit as correct, if it is determined that the high-pressure supercooled liquid refrigerant enthalpy is less than the high-pressure saturated liquid enthalpy and that the low-pressure two-phase refrigerant enthalpy is greater than the low-pressure saturated liquid enthalpy.

11. The air-conditioning apparatus of claim 9, wherein the composition determining function unit:

computes a high-pressure saturated liquid temperature and a low-pressure saturated liquid temperature, on a basis of a previously determined relationship of pressure and composition of the refrigerant to saturated liquid temperature, the high-pressure side pressure, the low-pressure side pressure, and composition of the refrigerant at charge; and determines the computation result of the composition computing function unit as correct, if it is determined that the supercooled liquid refrigerant temperature is less than the high-pressure saturated liquid temperature and that the two-phase refrigerant temperature is greater than the low-pressure saturated liquid temperature.

12. The air-conditioning apparatus of claim 9, wherein the composition determining function unit:

computes a high-pressure supercooled refrigerant quality from a previously determined relationship of pressure, temperature, and composition of the refrigerant to quality of the refrigerant, the supercooled liquid refrigerant temperature, the high-pressure side pressure, and composition of the refrigerant at charge;

computes a low-pressure two-phase refrigerant quality from the previously determined relationship of pressure, temperature, and composition of the refrigerant to quality of the refrigerant, the two-phase refrigerant temperature, the low-pressure side pressure, and the composition of the refrigerant at charge; and determines the computation result of the composition computing function unit as correct, if it is determined that the high-pressure supercooled refrigerant quality is less than or equal to 0 and that the low-pressure two-phase refrigerant quality is greater than 0.

13. The air-conditioning apparatus of claim 9, wherein the composition determining function unit makes a determination while allowing for a margin to avoid an erroneous determination due to a shift in parameter calculation result, the shift in parameter calculation result being caused by at least one of a difference between the circulating composition computed by the composition computing function unit and composition of the refrigerant at charge and detection errors introduced by the supercooled liquid temperature detecting device, the high-pressure side pressure detecting device, the two-phase refrigerant temperature detecting device, and the low-pressure side pressure detecting device.

14. The air-conditioning apparatus of claim 9, further comprising:

an outdoor fan that blows outside air to the outdoor-side heat exchanger, wherein the controller controls at least one of a frequency of the compressor and a rotation speed of the outdoor fan on a basis of the circulating composition that is adopted from either the pre-determined value of the composition of each of the plurality of components or the computation result of the composition computing function unit.

15. The air-conditioning apparatus of claim 9, further comprising:

an accumulator that accumulates a surplus refrigerant, the accumulator being provided on a suction side of the compressor within the refrigerant circuit, wherein a composition detection circuit is formed, the composition detection circuit having a first pipe to which a part of the refrigerant discharged by the compressor is bypassed, a second pipe that causes the refrigerant branched to the first pipe to merge with the refrigerant sucked into the compressor, a second expansion device that reduces a pressure of a flow of refrigerant through the first pipe and causes the refrigerant to flow to the second pipe, and a composition detection heat exchanger that exchanges heat between the flow of refrigerant through the first pipe and a flow of refrigerant out of the second expansion device, and wherein the supercooled liquid temperature detecting device, the two-phase refrigerant temperature detecting device, the high-pressure side pressure detecting device, and the low-pressure side pressure detecting device are installed in the composition detection circuit.

* * * * *